US009479858B2

(12) United States Patent
Kulavik

(10) Patent No.: US 9,479,858 B2
(45) Date of Patent: Oct. 25, 2016

(54) METHOD AND SYSTEM FOR ELECTRONIC PACKAGING FOR A HEADSET

(71) Applicant: Voyetra Turtle Beach, Inc., Valhalla, NY (US)

(72) Inventor: Richard Kulavik, San Jose, CA (US)

(73) Assignee: Voyetra Turtle Beach, Inc., Valhalla, NY (US)

( * ) Notice: Subject to any disclaimer, the term of this patent is extended or adjusted under 35 U.S.C. 154(b) by 71 days.

(21) Appl. No.: 14/446,580

(22) Filed: Jul. 30, 2014

(65) Prior Publication Data

US 2015/0117661 A1 Apr. 30, 2015

Related U.S. Application Data

(60) Provisional application No. 61/895,664, filed on Oct. 25, 2013.

(51) Int. Cl.

| | |
|---|---|
| ***H04R 1/10*** | (2006.01) |
| *B42D 5/02* | (2006.01) |
| *H04S 7/00* | (2006.01) |

(52) U.S. Cl.

CPC ..... *H04R 1/1041* (2013.01); *B42D 5/022* (2013.01); *H04R 1/1008* (2013.01); *H04R 2201/107* (2013.01); *H04R 2430/01* (2013.01); *H04R 2460/07* (2013.01); *H04R 2460/17* (2013.01); *H04S 7/304* (2013.01)

(58) Field of Classification Search

CPC H04R 1/1091; H04R 1/1008; H04R 1/1041; H04R 2201/107; H04R 2460/17

USPC ..... 381/74, 334, 388, 124; 40/124.03

See application file for complete search history.

(56) References Cited

U.S. PATENT DOCUMENTS

| | | | | |
|---|---|---|---|---|
| 7,356,154 | B1 * | 4/2008 | Kotzin | H04R 1/028 381/123 |
| 2004/0066275 | A1 * | 4/2004 | Mickler | F41C 33/06 340/5.33 |
| 2006/0031245 | A1 * | 2/2006 | Krieglstein | 707/102 |
| 2008/0135437 | A1 * | 6/2008 | Taneri | B65D 5/4212 206/459.1 |
| 2010/0287799 | A1 * | 11/2010 | Clegg | B42D 15/022 40/124.02 |
| 2011/0054830 | A1 * | 3/2011 | Logan | G06F 3/011 702/141 |
| 2012/0014553 | A1 * | 1/2012 | Bonanno | H03G 3/341 381/364 |
| 2014/0251851 | A1 * | 9/2014 | Huntley | 206/459.1 |

* cited by examiner

*Primary Examiner* — Disler Paul
(74) *Attorney, Agent, or Firm* — McAndrews, Held & Malloy

(57) ABSTRACT

A product packaging comprises circuitry and a speaker that are operable to detect when the product packaging is opened and/or removed from the packaging, and in response to detecting the removal and/or opening, play one or more pre-loaded audio messages via the speaker. The pre-loaded audio message includes a welcome message and/or setup instructions, which may be interactive. The circuitry and/or the speaker generates an interactive audio dialog that is utilized to customize setup of the product (e.g., a gaming headset), and may receive corresponding audio responses from a user of the gaming headset, in response to one or more audio prompts for the interactive audio dialog. The circuitry and/or the speaker may select settings for the gaming headset based on the received corresponding audio responses. The circuitry and/or the speaker may configure the gaming headset based on the selected settings and generate an audio summary of the selected settings.

16 Claims, 16 Drawing Sheets

METHOD AND SYSTEM FOR ELECTRONIC PACKAGING FOR A HEADSET

PRIORITY CLAIM

This application claims the benefit of priority to U.S. provisional patent application 61/895,664 titled "Method and System for Electronic Packaging for a Headset," which is hereby incorporated herein by reference in its entirety.

INCORPORATION BY REFERENCE

U.S. patent application Ser. No. 13/040,144 titled "Game Headset with Programmable Audio" and published as US2012/0014553 is hereby incorporated herein by reference in its entirety.

TECHNICAL FIELD

Aspects of the present application relate to electronic gaming. More specifically, to methods and systems for electronic packaging for a headset.

BACKGROUND

Limitations and disadvantages of conventional approaches to audio processing for gaming will become apparent to one of skill in the art, through comparison of such approaches with some aspects of the present method and system set forth in the remainder of this disclosure with reference to the drawings.

BRIEF SUMMARY

Methods and systems are provided for electronic packaging for a headset, substantially as illustrated by and/or described in connection with at least one of the figures, as set forth more completely in the claims.

DETAILED DESCRIPTION

Certain embodiments of the disclosure may be found in a method and system for electronic packaging for a headset or other product. In accordance with various embodiments of the disclosure, a product packaging comprises circuitry and a speaker that are operable to detect when the packaging is opened and/or when the product is removed from the packaging. In response to detecting the removal and/or opening, one or more pre-loaded audio messages may be played via the speaker. The pre-loaded audio message may include a welcome message and/or setup instructions. The setup instructions may be interactive. For example, as each part is pulled out of the packaging, the circuitry and/or the speaker may provide instructions on what to do with each part (e.g., with respect to assembly or set-up) and what is the next part that is to be pulled out of the packaging.

The circuitry and/or the speaker may generate an interactive audio dialog that is utilized to customize setup of the gaming headset, and may receive one or more corresponding audio responses from a user of the gaming headset, in response to one or more audio prompts for the interactive audio dialog. The circuitry and/or the speaker may select one or more settings for the gaming headset based on the received one or more corresponding audio responses. The circuitry and/or the speaker may configure the gaming headset based on the selected one or more settings, generate an audio summary of the selected one or more settings, and/or present an audio and/or visual notification when the configuring of the gaming headset is complete.

Figure 1A:
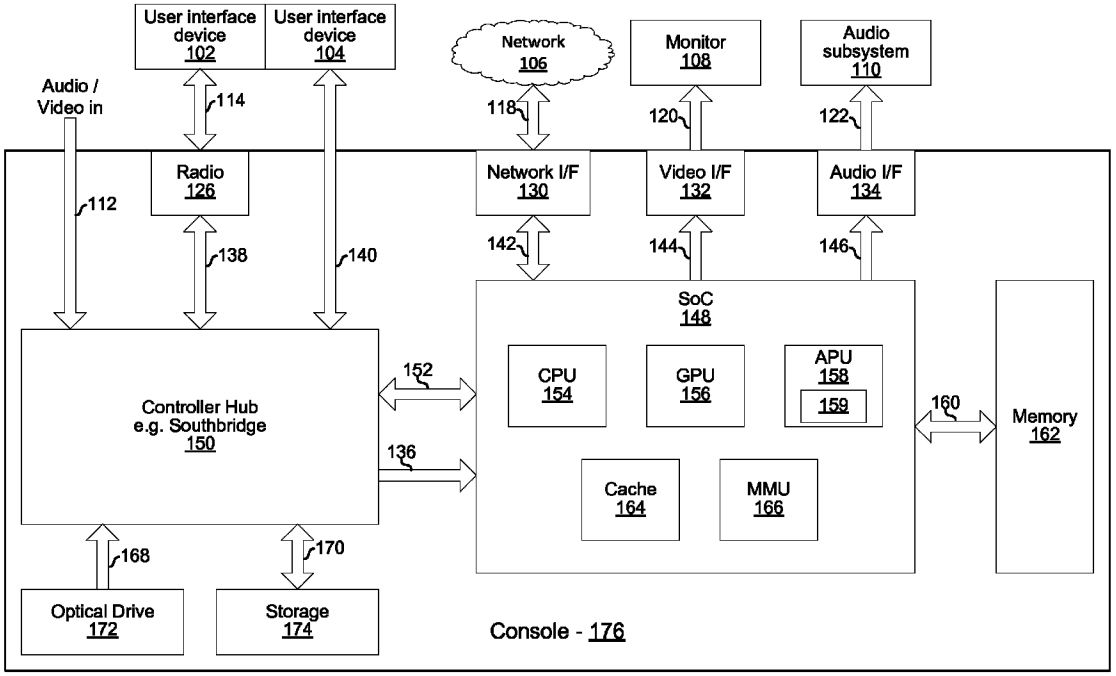
FIG. 1A is a diagram that depicts an example gaming console, which may be utilized to communicate with a gaming headset, in accordance with various exemplary embodiments of the disclosure.

FIG. 1A is a diagram that depicts an example gaming console, which may be utilized to communicate with a game, in accordance with various exemplary embodiments of the disclosure. Referring to FIG. 1A, there is shown a console 176, user interface devices 102, 104, a monitor 108, an audio subsystem 110, and a network 106.

The game console 176 may comprise suitable logic, circuitry, interfaces and/or code that may be operable to present a game to, and also enable game play interaction between, one or more local players and/or one or more remote players. The game console 176 which may be, for example, a Windows computing device, a Unix computing device, a Linux computing device, an Apple OSX computing device, an Apple iOS computing device, an Android computing device, a Microsoft Xbox, a Sony Playstation, a Nintendo Wii, or the like. The example game console 176 comprises a radio 126, network interface 130, video interface 132, audio interface 134, controller hub 150, main system on chip (SoC) 148, memory 162, optical drive 172, and storage device 174. The SoC 148 comprises central processing unit (CPU) 154, graphics processing unit (GPU) 156, audio processing unit (APU) 158, cache memory 164, and memory management unit (MMU) 166. The various components of the game console 176 are communicatively coupled through various buses/links 112, 138, 140, 142, 144, 146, 152, 136, 160, 168, and 170.

The controller hub 150 comprises circuitry that supports one or more data bus protocols such as High-Definition Multimedia Interface (HDMI), Universal Serial Bus (USB), Serial Advanced Technology Attachment II, III or variants thereof (SATA II, SATA III), embedded multimedia card interface (e.MMC), Peripheral Component Interconnect Express (PCIe), or the like. The controller hub 150 may also be referred to as an input/output (I/O) controller hub. Exemplary controller hubs may comprise Southbridge, Haswell, Fusion and Sandybridge. The controller hub 150 may be operable to receive audio and/or video from an external source via link 112 (e.g., HDMI), from the optical drive (e.g., Blu-Ray) 172 via link 168 (e.g., SATA II, SATA III), and/or from storage 174 (e.g., hard drive, FLASH memory, or the like) via link 170 (e.g., SATA II, III and/or e.MMC). Digital audio and/or video is output to the SoC 148 via link 136 (e.g., CEA-861-E compliant video and IEC 61937 compliant audio). The controller hub 150 exchanges data with the radio 126 via link 138 (e.g., USB), with external devices via link 140 (e.g., USB), with the storage 174 via the link 170, and with the SoC 148 via the link 152 (e.g., PCIe).

The radio 126 may comprise suitable logic, circuitry, interfaces and/or code that may be operable to communicate in accordance with one or more wireless standards such as the IEEE 802.11 family of standards, the Bluetooth family of standards, near field communication (NFC), and/or the like.

The network interface 130 may comprise suitable logic, circuitry, interfaces and/or code that may be operable to communicate in accordance with one or more wired standards and to convert between wired standards. For example, the network interface 130 may communicate with the SoC 148 via link 142 using a first standard (e.g., PCIe) and may communicate with the network 106 using a second standard (e.g., gigabit Ethernet).

The video interface 132 may comprise suitable logic, circuitry, interfaces and/or code that may be operable to communicate video in accordance with one or more wired or wireless video transmission standards. For example, the video interface 132 may receive CEA-861-E compliant video data via link 144 and encapsulate/format, etc., the video data in accordance with an HDMI standard for output to the monitor 108 via an HDMI link 120.

The audio interface 134 may comprise suitable logic, circuitry, interfaces and/or code that may be operable to communicate audio in accordance with one or more wired or wireless audio transmission standards. For example, the audio interface 134 may receive CEA-861-E compliant audio data via the link 146 and encapsulate/format, etc. the video data in accordance with an HDMI standard for output to the audio subsystem 110 via an HDMI link 122.

The central processing unit (CPU) 154 may comprise suitable logic, circuitry, interfaces and/or code that may be operable to execute instructions for controlling/coordinating the overall operation of the game console 176. Such instructions may be part of an operating system of the device 192 (FIG. 1C) and/or part of one or more software applications running on the device 192 (FIG. 1C).

The graphics processing unit (GPU) 156 may comprise suitable logic, circuitry, interfaces and/or code that may be operable to perform graphics processing functions such as compression, decompression, encoding, decoding, 3D rendering, and/or the like.

The audio processing unit (APU) 158 may comprise suitable logic, circuitry, interfaces and/or code that may be operable to perform audio processing functions such as volume/gain control, compression, decompression, encoding, decoding, surround-sound processing, and/or the like to output single channel or multi-channel (e.g., 2 channels for stereo or 5, 7, or more channels for surround sound) audio signals. The APU 158 comprises memory (e.g., volatile and/or non-volatile memory) 159 which stores parameter settings to affect processing of audio by the APU 158. For example, the parameter settings may include a first audio gain/volume setting that determines, at least in part, a volume of game audio output by the console 176 and a second audio gain/volume setting that determines, at least in part, a volume of chat audio output by the console 176. The parameter settings may be modified via a graphical user interface (GUI) of the console 176 and/or via an application programming interface (API) provided by the console 176.

The cache memory 164 may comprise suitable logic, circuitry, interfaces and/or code that may provide high-speed memory functions for use by the CPU 154, GPU 156, and/or APU 158. The cache memory 164 may typically comprise DRAM or variants thereof. The memory 162 may comprise additional memory for use by the CPU 154, GPU 156, and/or APU 158. The memory 162, typically DRAM, may operate at a slower speed than the cache memory 164 but may also be less expensive than cache memory as well as operate at a higher speed than the memory of the storage device 174. The MMU 166 controls accesses by the CPU 154, GPU 156, and/or APU 158 to the memory 162, the cache 164, and/or the storage device 174.

In FIG. 1A, the example game console 176 is communicatively coupled to the user interface device 102, the user interface device 104, the network 106, the monitor 108, and the audio subsystem 110.

Each of the user interface devices 102 and 104 may comprise, for example, a game controller, a keyboard, a motion sensor/position tracker, or the like. The user interface device 102 communicates with the game console 176 wirelessly via link 114 (e.g., Wi-Fi Direct, Bluetooth, NFC and/or the like). The user interface device 102 may be operable to communicate with the game console 176 via the wired link 140 (e.g., USB or the like).

The network 106 comprises a local area network and/or a wide area network. The game console 176 communicates with the network 106 via wired link 118 (e.g., Gigabit Ethernet).

The monitor 108 may be, for example, a LCD, OLED, or PLASMA screen. The game console 176 sends video to the monitor 108 via link 120 (e.g., HDMI).

The audio subsystem 110 may be, for example, a headset, a combination of headset and audio basestation, or a set of speakers and accompanying audio processing circuit. The game console 176 sends audio to the audio subsystem 110 via link(s) 122 (e.g., S/PDIF for digital audio or "line out" for analog audio). Additional details of an example audio subsystem 110 are described below.

Figure 1B:
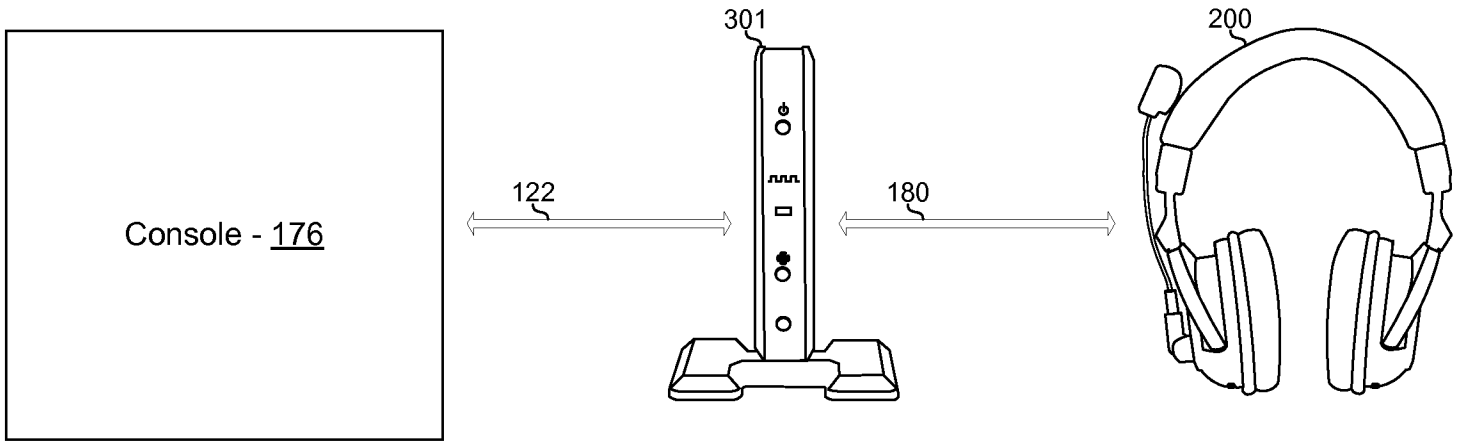
FIG. 1B is a diagram that depicts an example gaming audio subsystem comprising a headset and an audio basestation, in accordance with various exemplary embodiments of the disclosure.
Figure 1C:
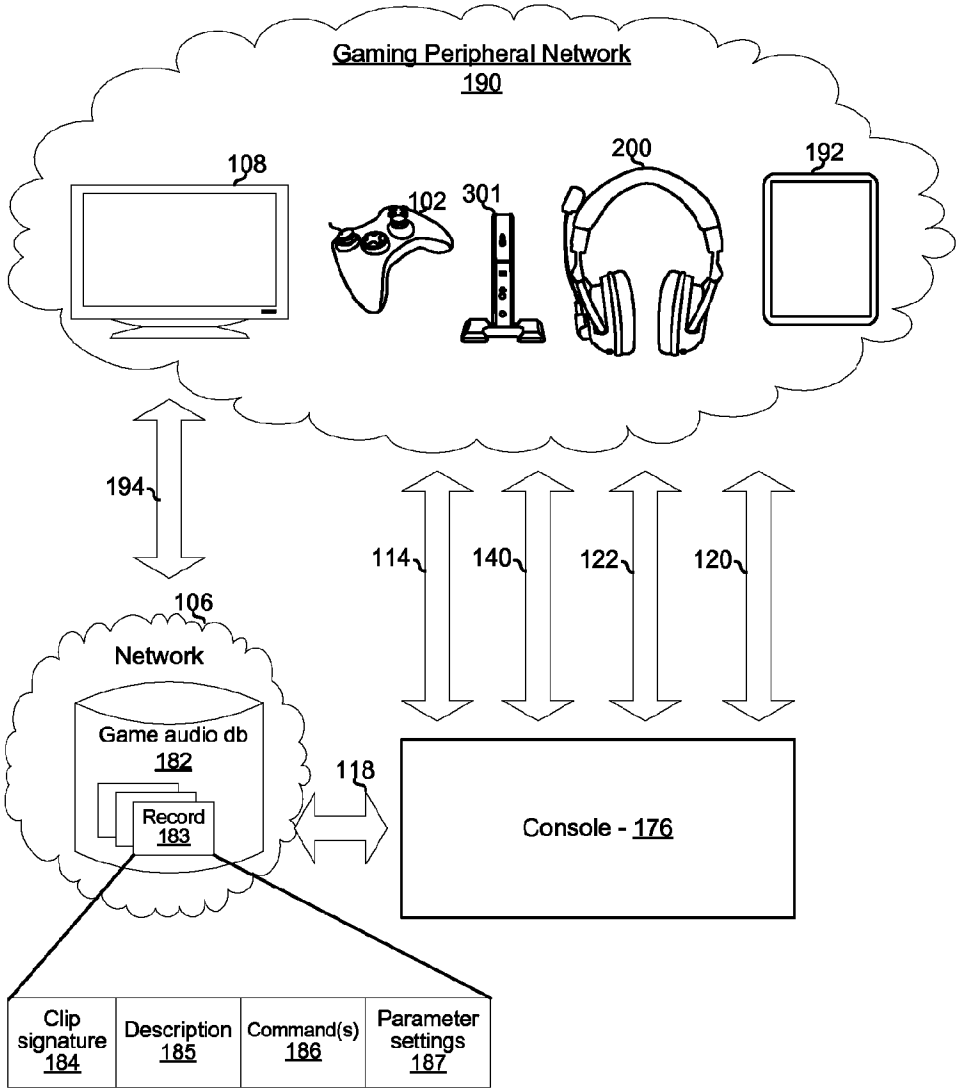
FIG. 1C is a diagram of an exemplary gaming console and an associated network of peripheral devices, in accordance with various exemplary embodiments of the disclosure.

FIG. 1B is a diagram that depicts an example gaming audio subsystem comprising a headset and an audio basestation, in accordance with various exemplary embodiments of the disclosure. Referring to FIG. 1B, there is shown a console 176, a headset 200 and an audio basestation 301. The headset 200 communicates with the basestation 301 via a link 180 and the basestation 301 communicates with the console 176 via a link 122. The link 122 may be as described above. In an example implementation, the link 180 may be a proprietary wireless link operating in an unlicensed frequency band. The headset 200 may be as described below with reference to FIGS. 2A-2C. The basestation 301 may be as described below with reference to FIGS. 3A-3B.

In operation, the headset 200 may be operable to determine or detect when it is being removed from its packaging and in response, may be operable to play a pre-loaded message such as a greeting or welcome message. The headset 200 may also be operable to provide instructions that may be utilized to unpack the headset 200 from the packaging, and setup, customize and/or configure the headset 200.

FIG. 1C is a diagram of an exemplary gaming console and an associated network of peripheral devices, in accordance with various exemplary embodiments of the disclosure. Referring to FIG. 1C, there is shown is the console 176, which is communicatively coupled to a plurality of peripheral devices and a network 106. The example peripheral devices shown include a monitor 108, a user interface device 102, a headset 200, an audio basestation 301, and a multi-purpose device 192.

The monitor 108 and the user interface device 102 are as described above. The headset 200 is as described below with reference to FIGS. 2A-2C. The audio basestation is as described below with reference to, for example, FIGS. 3A-3B.

The multi-purpose device 192 may comprise, for example, a tablet computer, a smartphone, a laptop computer, or the like and that runs an operating system such as Android, Linux, Windows, iOS, OSX, or the like. An example multi-purpose device is described below with reference to FIG. 4. Hardware (e.g., a network adaptor) and software (i.e., the operating system and one or more applications loaded onto the device 192) may configure the device 192 for operating as part of the GPN 190. For example, an application running on the device 192 may cause display of a graphical user interface (GUI), which may enable a user to access gaming-related data, commands, functions, parameter settings, and so on. The graphical user interface may enable a user to interact with the console 176 and the other devices of the GPN 190 to enhance the user's gaming experience.

The peripheral devices 102, 108, 192, 200, 300 are in communication with one another via a plurality of wired and/or wireless links (represented visually by the placement of the devices in the cloud of GPN 190). Each of the peripheral devices in the gaming peripheral network (GPN) 190 may communicate with one or more others of the peripheral devices in the GPN 190 in a single-hop or multi-hop fashion. For example, the headset 200 may communicate with the basestation 301 in a single hop (e.g., over a proprietary RF link) and with the device 192 in a single hop (e.g., over a Bluetooth or Wi-Fi direct link), while the tablet may communicate with the basestation 301 in two hops via the headset 200. As another example, the user interface device 102 may communicate with the headset 200 in a single hop (e.g., over a Bluetooth or Wi-Fi direct link) and with the device 192 in a single hop (e.g., over a Bluetooth or Wi-Fi direct link), while the device 192 may communicate with the headset 200 in two hops via the user interface device 102. These example interconnections among the peripheral devices of the GPN 190 are merely examples, any number and/or types of links and/or hops among the devices of the GPN 190 is possible.

The GPN 190 may communicate with the console 176 via any one or more of the connections 114, 140, 122, and 120 described above. The GPN 190 may communicate with a network 106 via one or more links 194 each of which may be, for example, Wi-Fi, wired Ethernet, and/or the like.

A database 182 which stores gaming audio data is accessible via the network 106. The gaming audio data may comprise, for example, signatures (or "acoustic fingerprint") of particular audio clips (e.g., individual sounds or collections or sequences of sounds) that are part of the game audio of particular games, of particular levels/scenarios of particular games, particular characters of particular games, etc. In an example implementation, the database 182 may comprise a plurality of records 183, where each record 183 comprises an audio clip (or signature of the clip) 184, a description of the clip 185 (e.g., the game it is from, when it occurs in the game, etc.), one or more gaming commands 186 associated with the clip, one or more parameter settings 187 associated with the clip, and/or other data associated with the audio clip. Records 183 of the database 182 may be downloadable to, or accessed in real-time by, one of more devices of the GPN 190.

Figure 2A:
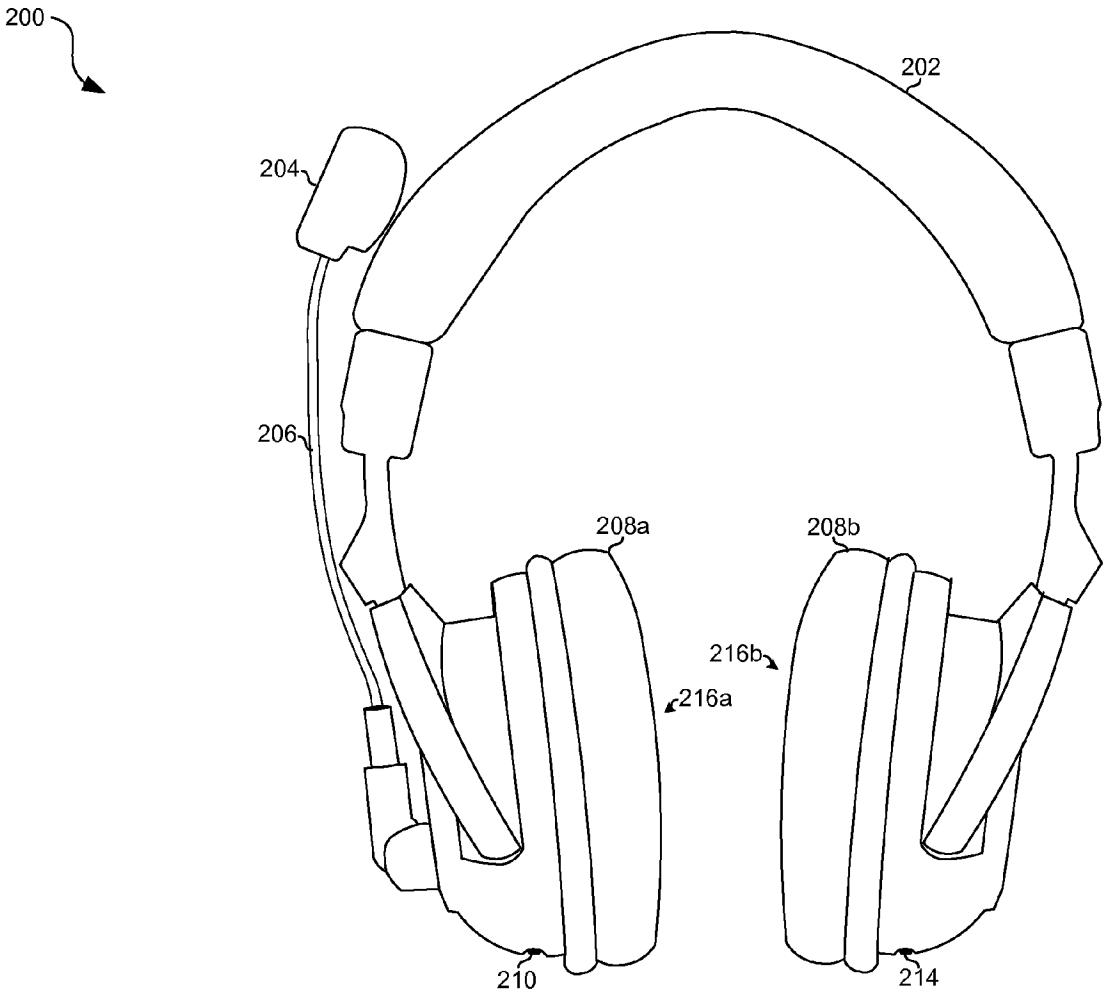
FIGS. 2A and 2B are diagrams that depict two views of an example embodiment of a gaming headset, in accordance with various exemplary embodiments of the disclosure.
Figure 2B:
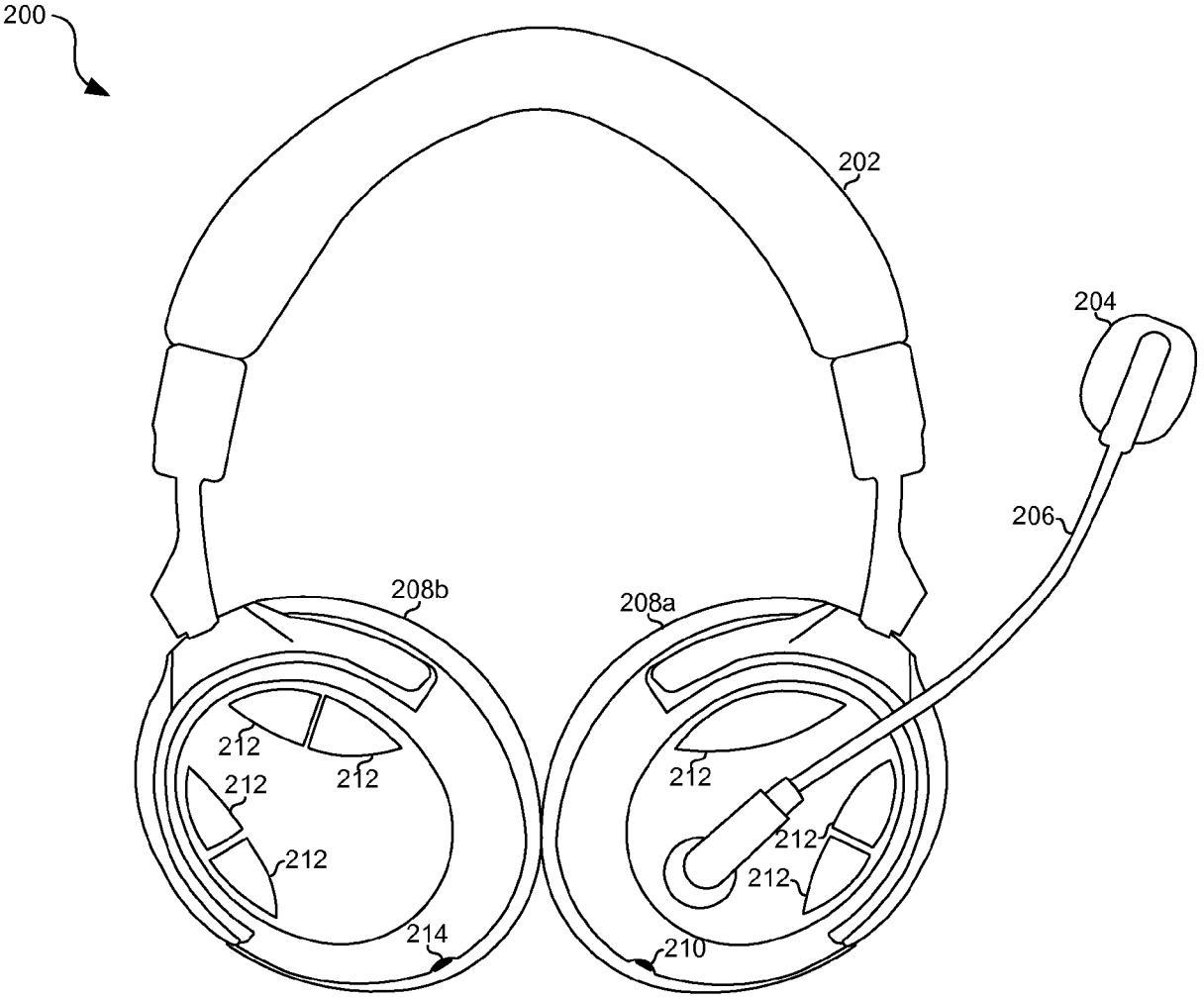

FIGS. 2A and 2B are diagrams that depict two views of an example embodiment of a gaming headset, in accordance with various exemplary embodiments of the disclosure. Referring to FIGS. 2A and 2B, there are shown two views of an example headset 200 that may present audio output by a gaming console such as the console 176. The headset 200 comprises a headband 202, a microphone boom 206 with microphone 204, ear cups 208*a* and 208*b* which surround speakers 216*a* and 216*b*, connector 210, connector 214, and user controls 212.

The connector 210 may be, for example, a 3.5 mm headphone socket for receiving analog audio signals (e.g., receiving chat audio via an Xbox "talkback" cable).

The microphone 204 may comprise suitable logic, circuitry, interfaces and/or code that may be operable to convert acoustic waves (e.g., the voice of the person wearing the headset) to electric signals for processing by circuitry of the headset and/or for output to a device (e.g., console 176, basestation 301, a smartphone, and/or the like) that is in communication with the headset.

The speakers 216*a* and 216*b* may comprise circuitry that may be operable to convert electrical signals to sound waves.

The user controls 212 may comprise dedicated and/or programmable buttons, switches, sliders, wheels, etc. for performing various functions. Example functions which the controls 212 may be configured to perform include: power the headset 200 on/off, mute/unmute the microphone 204, control gain/volume of, and/or effects applied to, chat audio by the audio processing circuit of the headset 200, control gain/volume of, and/or effects applied to, game audio by the audio processing circuit of the headset 200, enable/disable/initiate pairing (e.g., via Bluetooth, Wi-Fi direct, NFC, or the like) with another computing device, and/or the like. Some of the user controls 212 may adaptively and/or dynamically change during gameplay based on a particular game that is being played. Some of the user controls 212 may also adaptively and/or dynamically change during gameplay based on a particular player that is engage in the game play. The connector 214 may be, for example, a USB, thunderbolt, Firewire or other type of port or interface. The connector 214 may be used for downloading data to the headset 200 from another computing device and/or uploading data from the headset 200 to another computing device. Such data may include, for example, parameter settings (described below). Additionally, or alternatively, the connector 214 may be used for communicating with another computing device such as a smartphone, tablet compute, laptop computer, or the like.

Figure 2C:
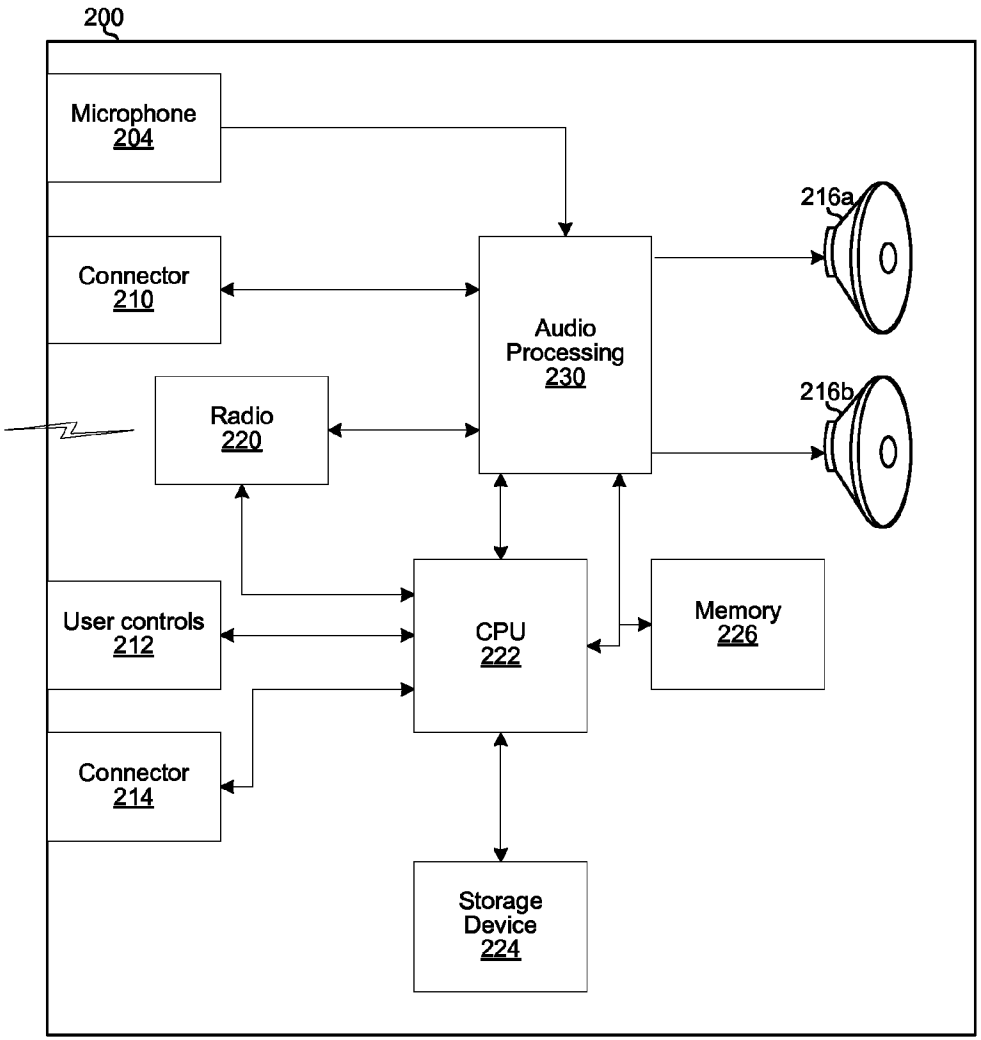
FIG. 2C is a diagram that depicts a block diagram of the example headset of FIGS. 2A and 2B, in accordance with various exemplary embodiments of the disclosure.

FIG. 2C is a diagram that depicts a block diagram of the example headset of FIGS. 2A and 2B, in accordance with various exemplary embodiments of the disclosure. Referring to FIG. 2C, there is shown a headset 200. In addition to the connector 210, user controls 212, connector 214, microphone 204, and speakers 216*a* and 216*b* already discussed, shown are a radio 220, a CPU 222, a storage device 224, a memory 226, and an audio processing circuit 230.

The radio 220 may comprise suitable logic, circuitry, interfaces and/or code that may be operable to communicate in accordance with one or more standardized (such as, for example, the IEEE 802.11 family of standards, NFC, the Bluetooth family of standards, and/or the like) and/or proprietary wireless protocol(s) (e.g., a proprietary protocol for receiving audio from an audio basestation such as the basestation 301).

The CPU 222 may comprise suitable logic, circuitry, interfaces and/or code that may be operable to execute instructions for controlling/coordinating the overall operation of the headset 200. Such instructions may be part of an operating system or state machine of the headset 200 and/or part of one or more software applications running on the headset 200. In some implementations, the CPU 222 may be, for example, a programmable interrupt controller, a state machine, or the like.

The CPU 222 may also be operable to detect when the headset 200 is being removed from its packaging and in response, the CPU 222 may be operable to control operation of the audio processing circuit 230 to play a welcome message or greeting. The CPU 222 may also be operable to control the operation of the audio processing circuit 230 to play one or more preloaded messages. Exemplary preloaded messages may comprise a welcome message or greeting, unpacking instructions, setup instructions, configuration instructions, maintenance or care instructions, and/or customization instructions.

In accordance with various embodiments of the disclosure, the CPU 222 may be operable to establish an interactive setup session with the person that is unpacking and setting up the headset 200. In this regard, the CPU 222 may configure the audio processing circuit 230 to present a first question to the person setting up the headset 200. The person setting up the headset 200 may respond with a first response, which may, for example, be received via the microphone 204 and processed by the audio processing circuit 230. Based on the results from the processing by the audio processing circuit 230, the CPU 222 may select a first setting and configure a first parameter or option for the headset 200 with the selected first setting. In this regard, a plurality of parameters or options for the headset 200 may be configured. Additionally, or alternatively, the first response may be detected by another sensor of the headset 200 and/or input via controls 212 of the headset 200.

For the interactive session, the CPU 222 may also be operable to guide the person that is removing the headset 200 from its packaging through the steps that should be utilized for unpacking or removing the headset 200 from its packaging. In this regard, the audio processing circuit 230 and the CPU 222 may be operable to generate instructions comprising a plurality of sequential steps, which may be played through the speakers 216*a*, 216*b*. The plurality of sequential steps may inform the person that is removing the headset 200 of the order in which the parts in the packaging should be removed and what should be done with each part (e.g., with respect to assembly or set-up). As each part is pulled out of the packaging, the CPU 222, audio processing circuit 230, and/or the speakers 216*a*, 216*b* may be operable to provide instructions on what to do with each part and what is the next part that is to be pulled out of the packaging. The sequence of the steps may be dependent on the responses that are received from the person that is removing the headset 200 from its packaging. In this regard, each of the sequential steps may occur as a result of a response that may be received from the person that is removing the headset 200 from its packaging.

The storage device 224 may comprise suitable logic, circuitry, interfaces and/or code that may comprise, for example, FLASH or other nonvolatile memory, which may be operable to store data comprising operating data, configuration data, settings, and so on, which may be used by the CPU 222 and/or the audio processing circuit 230. Such data may include, for example, parameter settings that affect processing of audio signals in the headset 200 and parameter settings that affect functions performed by the user controls 212. For example, one or more parameter settings may determine, at least in part, a gain of one or more gain elements of the audio processing circuit 230. As another example, one or more parameter settings may determine, at least in part, a frequency response of one or more filters that operate on audio signals in the audio processing circuit 230. As another example, one or more parameter settings may determine, at least in part, whether and which sound effects are added to audio signals in the audio processing circuit 230 (e.g., which effects to add to microphone audio to morph the user's voice). Example parameter settings which affect audio processing are described in the co-pending U.S. patent application Ser. No. 13/040,144 titled "Game headset with Programmable Audio" and published as US2012/0014553, the entirety of which is hereby incorporated herein by reference. Particular parameter settings may be selected autonomously by the headset 200 in accordance with one or more algorithms, based on user input (e.g., via controls 212), and/or based on input received via one or more of the connectors 210 and 214.

The storage device 224 may also be operable to store audio information corresponding to the one or more preloaded messages comprising the welcome message or greeting and to provide unpacking instructions, setup instructions, configuration instructions, maintenance or care instructions, and/or customization instructions. The CPU 222 may also be operable to retrieve the audio information corresponding to the preloaded messages from the storage device 224 and control the operation of the audio processing circuit 230 to play the preloaded messages.

The memory 226 may comprise suitable logic, circuitry, interfaces and/or code that may comprise volatile memory used by the CPU 222 and/or audio processing circuit 230 as program memory, for storing runtime data, and so on. In this regard, the memory 226 may comprise information and/or data that may be utilized to control operation of the audio processing circuit 230 to provide playback of one or more preloaded messages such as the welcome message or greeting, the unpacking instructions, the setup instructions, the configuration instructions, the maintenance or care instructions, and/or the customization instructions.

The audio processing circuit 230 may comprise suitable logic, circuitry, interfaces and/or code that may be operable to perform audio processing functions such as volume/gain control, compression, decompression, encoding, decoding, introduction of audio effects (e.g., echo, phasing, virtual surround effect, etc.), and/or the like. As described above, the processing performed by the audio processing circuit 230 may be determined, at least in part, by which parameter settings have been selected. The processing performed by the audio processing circuit 230 may also be determined based on default settings, player preference, and/or by adaptive and/or dynamic changes to the game play environment. The processing may be performed on game, chat, and/or microphone audio that is subsequently output to speaker 216*a* and 216*b*. Additionally, or alternatively, the processing may be performed on chat audio that is subsequently output to the connector 210 and/or radio 220.

The audio processing circuit 230 may be operable to play one or more preloaded messages such as the welcome message or greeting, the unpacking instructions, the setup instructions, the configuration instructions, the maintenance or care instructions, and/or the customization instructions. The CPU 222 may be operable to configure the audio processing circuit 230 to play one or more of the preloaded messages. The audio processing circuit 230 may also be operable to process one or more responses that may be received from the person setting up the headset as part of the interactive instructions that are controlled by the CPU 222. In this regard, the audio processing circuit 230 may also be operable to process the one or more responses that may be received from a person setting up the headset. Based on the results of the processed one or more responses, the CPU 222 may be operable to control playback of the predefined messages, and/or select one or more settings that may be utilized to setup and configure the headset 200. The CPU 222 may also be operable to customize the headset 200 for the person setting up the headset 200 based on the results of the processing of the one or more responses by the audio processing circuit 230.

In operation, the CPU 222 may be operable to detect when the headset 200 is being removed from its packaging (e.g., based on a button press that is necessary during removal, based on a disconnection of a magnetic connection between the headset and the packaging, based on a disconnection of a conductive connection between the headset and the packaging, and/or the like). In instances when the CPU 222 detects that the headset 200 is being removed, the audio processing circuit 230 may be operable to play one or more pre-loaded audio message via the speakers 216*a*, 216*b*. The pre-loaded audio message may comprise the welcome message or greeting, the unpacking instructions, the setup instructions, the configuration instructions, the maintenance or care instructions, and/or the customization instructions. The pre-loaded messages may be utilized to provide an interactive audio dialog between the headset 200 and the person that is removing the headset 200 from its packaging and setting up the headset 200. In this regard, the headset 200, the audio processing circuit 230 and the CPU 222 may be operable to generate the interactive audio dialog that may be utilized to customize setup of the headset 200 for one or more users of the headset 200. The CPU 222 may control the audio processing circuit 230 to generate one or more audio prompts via the speakers 216*a*, 216*b*. In response to one or more audio prompts or instructions for the interactive audio dialog, which are generated from the speakers 216*a*, 216*b*, the audio processing circuit 230 may be operable to receive one or more corresponding responses, such as audio responses via the microphone 204 or interactions with the controls 212, from the person that may be removing the headset 200 from its packaging and setting up the headset 200. The audio processing circuit 230 may be operable to analyze the received one or more corresponding responses and, based on the analysis, the CPU 222 may be operable to select one or more settings for configuring one or more parameters or options for the headset 200.

The CPU 222 may be operable to control the audio processing circuit 230 to generate an audio summary and/or an acknowledgement of the selected one or more settings that were utilized for configuring one or more parameters or options for the headset 200. The CPU 222 and the audio processing circuit 230 may be operable to present an audio and/or visual notification when the configuring of the headset is complete. For example, the CPU 222 and the audio processing circuit 230 may play a special audio tone or clip via the speakers 216*a*, 216*b*, which indicates completion of the configuring. In another example, the CPU 222 may be operable to blink a light such as a LED on the headset 200, which indicates completion of the configuring.

Figure 3A:
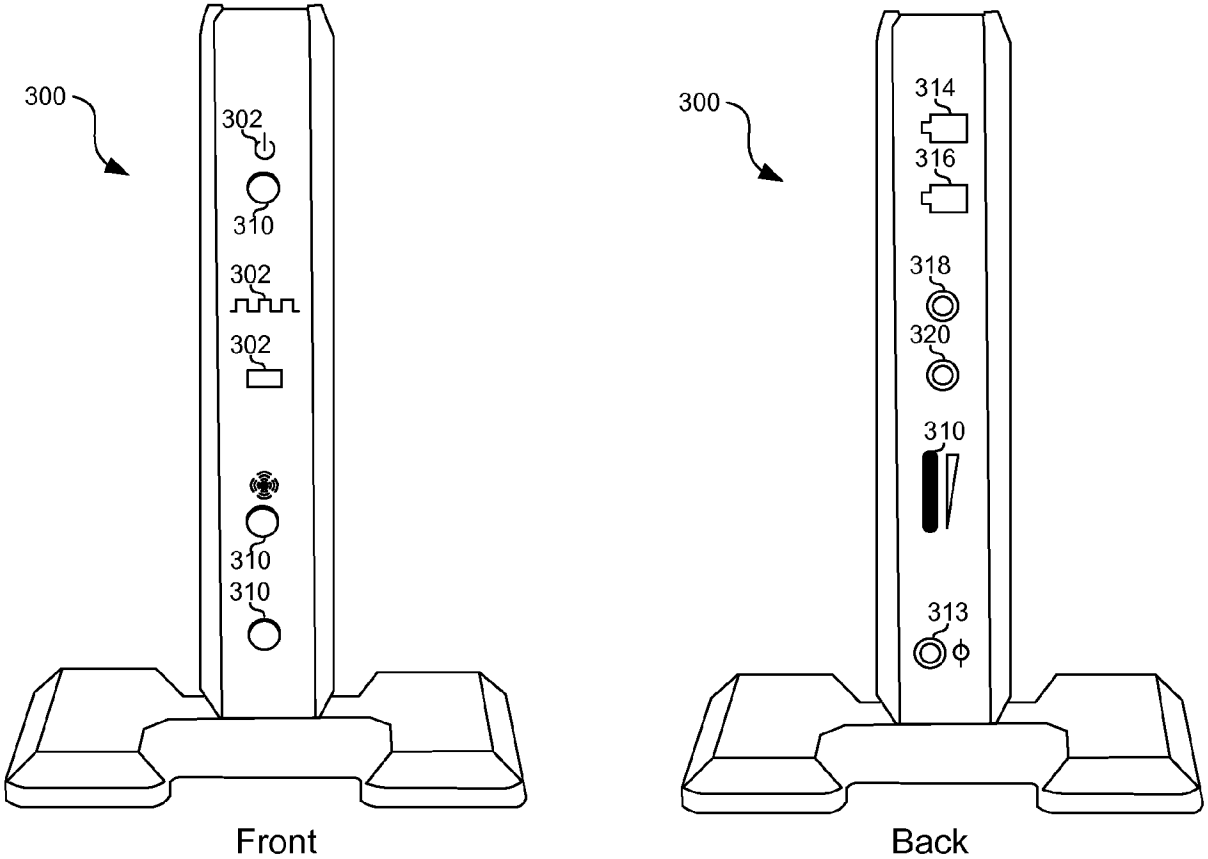
FIG. 3A is a diagram that depicts two views of an example embodiment of an audio basestation, in accordance with various exemplary embodiments of the disclosure.

FIG. 3A is a diagram that depicts two views of an example embodiment of an audio basestation, in accordance with various exemplary embodiments of the disclosure. Referring to FIG. 3A, there is shown an exemplary embodiment of an audio basestation 301. The basestation 301 comprises status indicators 302, user controls 310, power port 313, and audio connectors 314, 316, 318, and 320.

The audio connectors 314 and 316 may comprise digital audio in and digital audio out (e.g., S/PDIF) connectors, respectively. The audio connectors 318 and 320 may comprise a left "line in" and a right "line in" connector, respectively. The controls 310 may comprise, for example, a power button, a button for enabling/disabling virtual surround sound, a button for adjusting the perceived angles of the speakers when the virtual surround sound is enabled, and a dial for controlling a volume/gain of the audio received via the "line in" connectors 318 and 320. The status indicators 302 may indicate, for example, whether the audio basestation 301 is powered on, whether audio data is being received by the basestation 301 via connectors 314, and/or what type of audio data (e.g., Dolby Digital) is being received by the basestation 301.

Figure 3B:
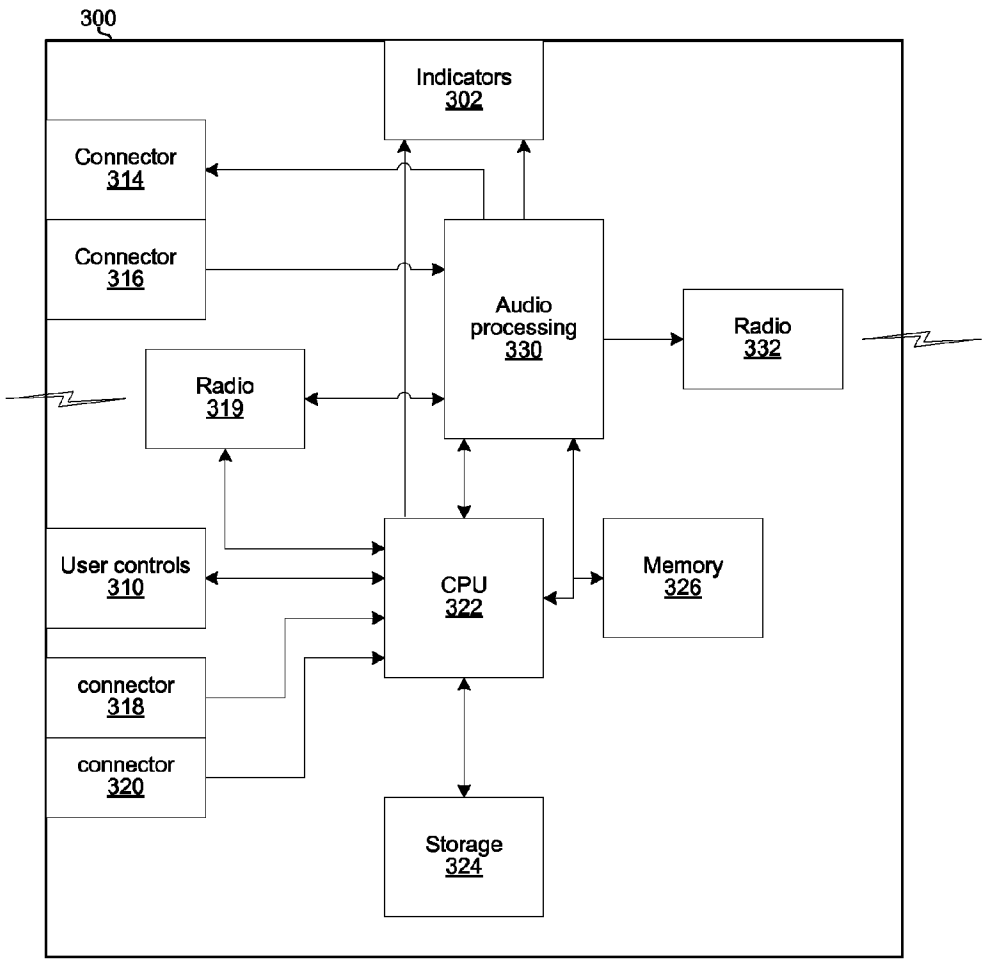
FIG. 3B is a diagram that depicts a block diagram of the audio basestation, in accordance with various exemplary embodiments of the disclosure.

FIG. 3B is a diagram that depicts a block diagram of the audio basestation 301, in accordance with various exemplary embodiments of the disclosure. Referring to FIG. 3B, there is shown an exemplary embodiment of an audio basestation 301. In addition to the user controls 310, indicators 302, and connectors 314, 316, 318, and 320 described above, the block diagram additionally shows a CPU 322, a storage device 324, a memory 326, a radio 319, an audio processing circuit 330, and a radio 332.

The radio 319 comprises suitable logic, circuitry, interfaces and/or code that may be operable to communicate in accordance with one or more standardized (such as the IEEE 802.11 family of standards, the Bluetooth family of standards, NFC, and/or the like) and/or proprietary (e.g., proprietary protocol for receiving audio protocols for receiving audio from a console such as the console 176) wireless protocols.

The radio 332 comprises suitable logic, circuitry, interfaces and/or code that may be operable to communicate in accordance with one or more standardized (such as, for example, the IEEE 802.11 family of standards, the Bluetooth family of standards, and/or the like) and/or proprietary wireless protocol(s) (e.g., a proprietary protocol for transmitting audio to the headphones 200).

The CPU 322 comprises suitable logic, circuitry, interfaces and/or code that may be operable to execute instructions for controlling/coordinating the overall operation of the audio basestation 301. Such instructions may be part of an operating system or state machine of the audio basestation 301 and/or part of one or more software applications running on the audio basestation 301. In some implementations, the CPU 322 may be, for example, a programmable interrupt controller, a state machine, or the like.

The storage 324 may comprise, for example, FLASH or other nonvolatile memory for storing data which may be used by the CPU 322 and/or the audio processing circuit 330. Such data may include, for example, parameter settings that affect processing of audio signals in the basestation 301. For example, one or more parameter settings may determine, at least in part, a gain of one or more gain elements of the audio processing circuit 330. As another example, one or more parameter settings may determine, at least in part, a frequency response of one or more filters that operate on audio signals in the audio processing circuit 330. As another example, one or more parameter settings may determine, at least in part, whether and which sound effects are added to audio signals in the audio processing circuit 330 (e.g., which effects to add to microphone audio to morph the user's voice). Example parameter settings which affect audio processing are described in the co-pending U.S. patent application Ser. No. 13/040,144 titled "Game headset with Programmable Audio" and published as US2012/0014553, the entirety of which is hereby incorporated herein by reference. Particular parameter settings may be selected autonomously by the basestation 301 in accordance with one or more algorithms, based on user input (e.g., via controls 310), and/or based on input received via one or more of the connectors 314, 316, 318, and 320.

The memory 326 may comprise volatile memory used by the CPU 322 and/or audio processing circuit 330 as program memory, for storing runtime data, etc.

The audio processing circuit 330 may comprise suitable logic, circuitry, interfaces and/or code that may be operable to perform audio processing functions such as volume/gain control, compression, decompression, encoding, decoding, introduction of audio effects (e.g., echo, phasing, virtual surround effect, etc.), and/or the like. As described above, the processing performed by the audio processing circuit 330 may be determined, at least in part, by which parameter settings have been selected. The processing may be performed on game and/or chat audio signals that are subsequently output to a device (e.g., headset 200) in communication with the basestation 301. Additionally, or alternatively, the processing may be performed on a microphone audio signal that is subsequently output to a device (e.g., console 176) in communication with the basestation 301.

Figure 4:
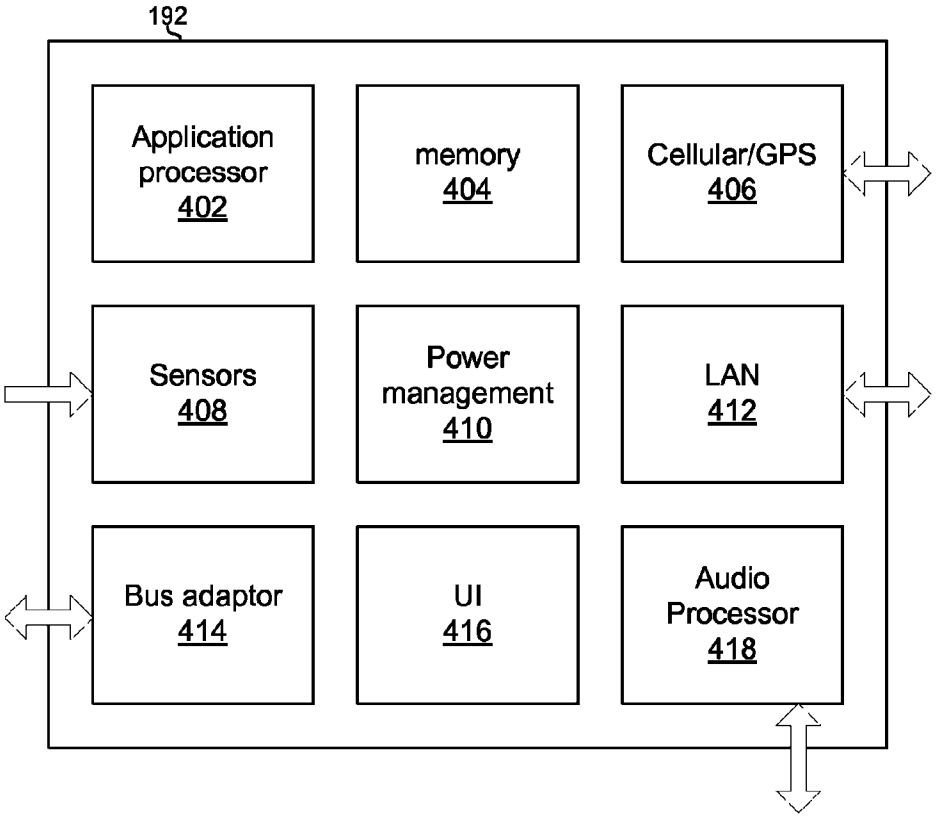
FIG. 4 is a block diagram of an exemplary multi-purpose device, in accordance with various exemplary embodiments of the disclosure.

FIG. 4 is a block diagram of an exemplary multi-purpose device 192, in accordance with various exemplary embodiments of the disclosure. The example multi-purpose device 192 comprises an application processor 402, memory subsystem 404, a cellular/GPS networking subsystem 406, sensors 408, power management subsystem 410, LAN subsystem 412, bus adaptor 414, user interface subsystem 416, and audio processor 418.

The application processor 402 comprises suitable logic, circuitry, interfaces and/or code that may be operable to execute instructions for controlling/coordinating the overall operation of the multi-purpose device 192 as well as graphics processing functions of the multi-purpose device 1922. Such instructions may be part of an operating system of the console and/or part of one or more software applications running on the console.

The memory subsystem 404 comprises volatile memory for storing runtime data, nonvolatile memory for mass storage and long-term storage, and/or a memory controller which controls reads/writes to memory.

The LAN subsystem 412 comprises suitable logic, circuitry, interfaces and/or code that may be operable to perform baseband processing and analog/RF processing for transmission and reception of wired, optical, and/or wireless signals (e.g., in accordance with Wi-Fi (IEEE 802.11 and variants thereof 802.11 e.g., a, b, g, n, ac, q, Wi-FI Direct), Bluetooth, Ethernet, and/or other standards).

The sensors 408 comprise, for example, a camera, a gyroscope, an accelerometer, a biometric sensor, and/or the like.

The power management subsystem 410 comprises suitable logic, circuitry, interfaces and/or code that may be operable to manage distribution of power among the various components of the multi-purpose device 192.

The cellular/GPS networking subsystem 406 comprises suitable logic, circuitry, interfaces and/or code that may be operable to perform baseband processing and analog/RF processing for transmission and reception of cellular and GPS signals.

The bus adaptor 414 comprises suitable logic, circuitry, interfaces and/or code that may be operable for interfacing one or more internal data busses of the multi-purpose device with an external bus (e.g., a Universal Serial Bus) for transferring data to/from the multi-purpose device via a wired connection.

The user interface subsystem 416 comprises suitable logic, circuitry, interfaces and/or code that may be operable to control and relay signals to/from a touchscreen, hard buttons, and/or other input devices of the multi-purpose device 192.

The audio processor 418 comprises suitable logic, circuitry, interfaces and/or code that may be operable to process (e.g., digital-to-analog conversion, analog-to-digital conversion, compression, decompression, encryption, decryption, resampling, etc.) audio signals. The audio processor 418 may be operable to receive and/or output signals via a connector such as a 3.5 mm stereo and microphone connector.

Figure 5A:
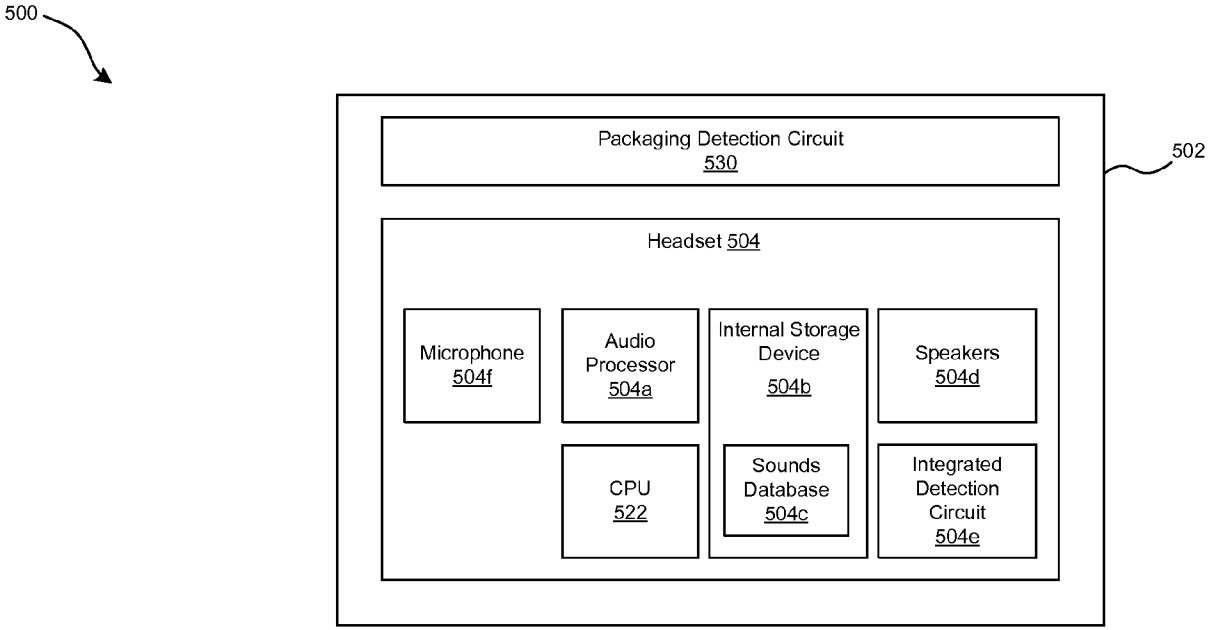
FIG. 5A is a block diagram illustrating an exemplary headset electronic packaging, in accordance with an embodiment of the disclosure.

FIG. 5A is a block diagram illustrating an exemplary headset electronic packaging, in accordance with an embodiment of the disclosure. Referring to FIG. 5A, there is shown a headset electronic packaging 500. The headset electronic packaging comprises packaging 502, a headset 504, and a packaging detection circuit 530. The headset 504 may comprise an audio processor 504*a*, an internal storage device 504*b*, speakers 504*d*, a CPU 522, integrated detection circuit 504*e*, and a microphone 505*f*. The internal storage device 504*b* may comprise a sounds database 504*c*.

The packaging detection circuit 530 may comprise suitable logic, circuitry, interfaces and/or code that may be operable to detect when the packaging 502 is being opened. In this regard, the packaging detection circuit 530 may comprise, for example, an element such as a conductor, switch (shown in FIG. 5B) or the like, that may activated when the packaging 502 is being opened and removed from the headset 504. The switch may be a low cost switch such as a magnetic switch in which a first portion of the magnetic switch is affixed to a first portion of the packaging 502 and a second portion of the magnetic switch (shown in FIG. 5C) is affixed to a second portion of the packaging 502. When the packaging 502 is being opened, the first portion of the conductor or switch on the first portion of the packaging 502 is separated from the second portion of the conductor or switch on the second portion of the packaging 502. The separation may cause activation of the switch. In the case of a conductor, the separation may cause the conductor to break and this breakage may trigger the communication of a signal from the package detection circuit 530 to the headset 504.

Figure 5B:
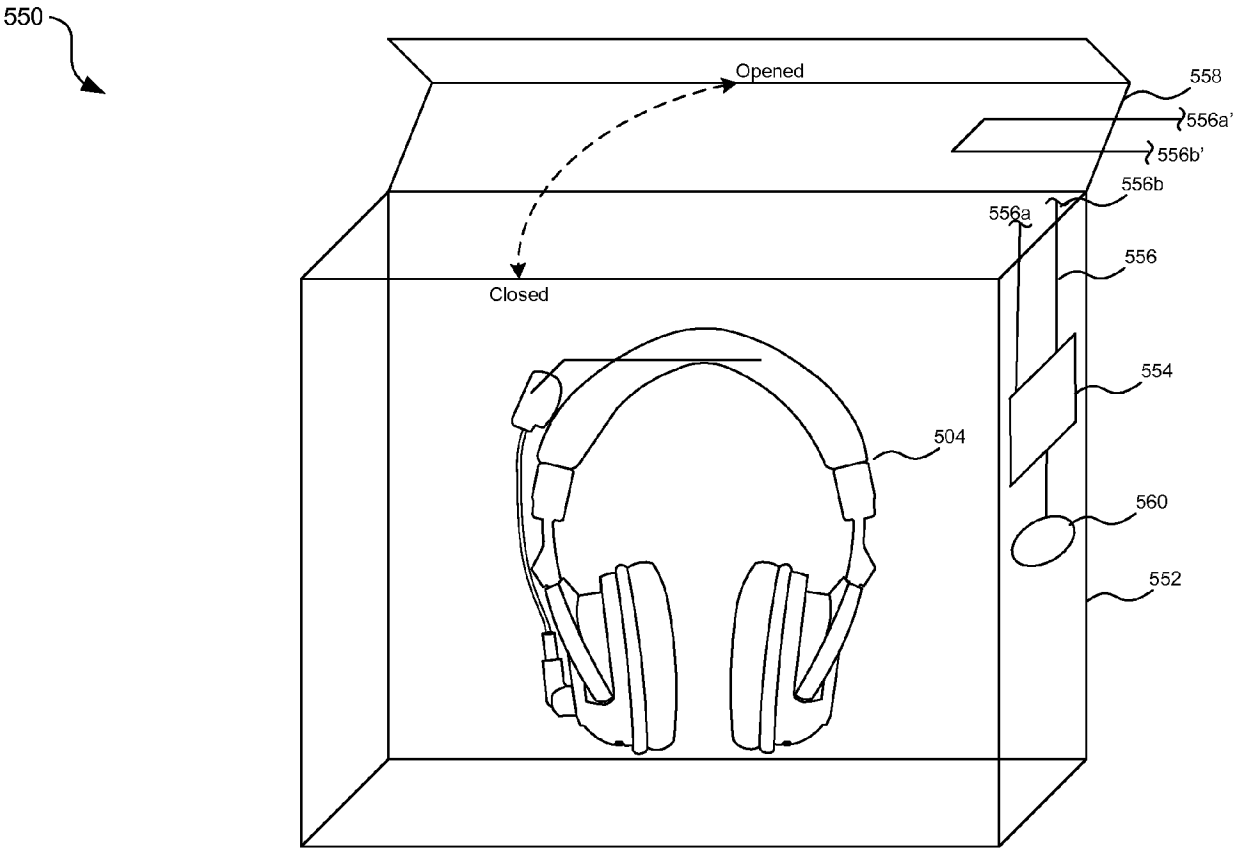
FIG. 5B is a diagram illustrating an exemplary electronic packaging for a headset, in accordance with various exemplary embodiments of the disclosure.
Figure 5C:
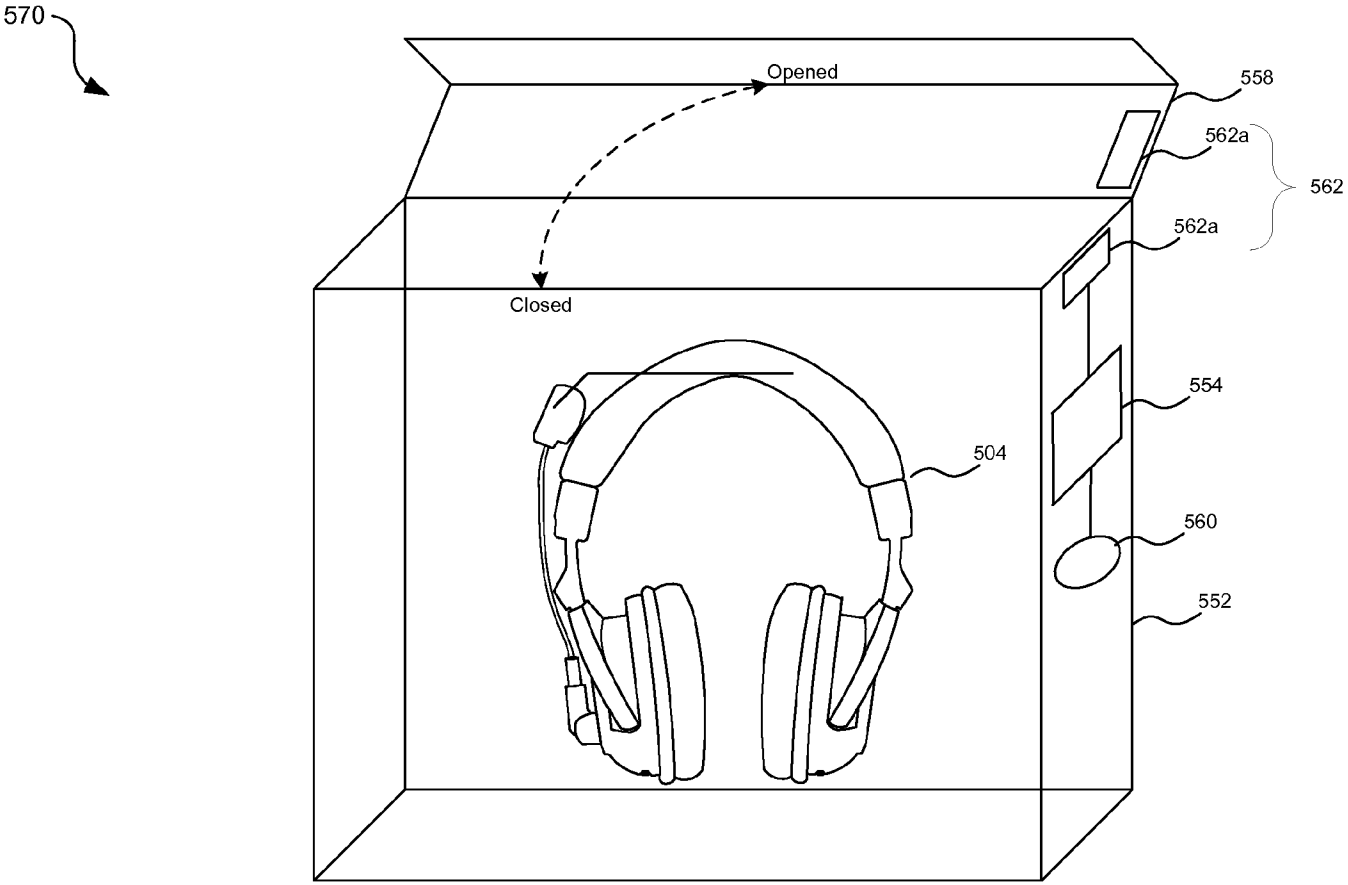
FIG. 5C is a diagram illustrating an exemplary electronic packaging for a headset, in accordance with various exemplary embodiments of the disclosure.
Figure 5D:
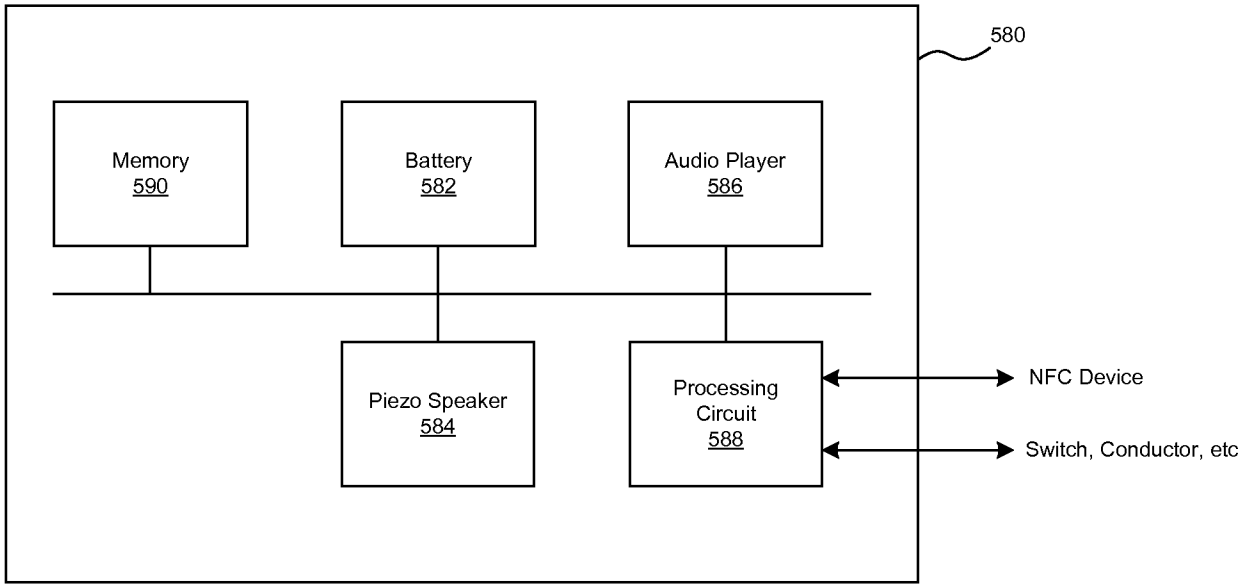
FIG. 5D is a block diagram of an exemplary package detection circuit, in accordance with various embodiments of the disclosure.

In some embodiments of the disclosure, the packaging detection circuit 530 may comprise a battery, a low cost audio player, and a piezo speaker, which are shown in FIG. 5D. When the switch is activated, this may cause the battery to power the low cost audio player and the low cost audio player may be operable to play one or more pre-loaded audio messages such as a welcome message or greeting, and/or setup and configuration instructions via the peizo speakers. In some embodiments of the disclosure, when the packaging 502 is being opened and removed from the headset 504, and the switch is activated, the packaging detection circuit 530 may be operable to send a signal to the headset 504. The signal that is sent to the headset 504 may cause the headset 504 to play one or more pre-loaded audio messages such as a welcome message or greeting, and/or setup and configuration instructions. The signal may comprise, for example, an NFC signal. In the case of the conductor, when the packaging 502 is being opened, the first portion of the conductor on the first portion of the packaging 502 is separated from the second portion of the conductor on the second portion of the packaging 502, this may cause the package detection circuit to trigger the low cost audio player to play one or more pre-loaded audio messages such as a welcome message or greeting, and/or setup and configuration instructions via the peizo speakers.

The headset 504 may comprise suitable logic, circuitry, interfaces and/or code that may be operable to receive the plurality of audio channels of game audio and/or chat audio. The headset 504 may be substantially similar to the headset 200, for example, which is shown in and described with respect to FIGS. 2A, 2B and 2C. The headset 504 may be operable to receive a signal from the packaging detection circuit 530 in instances when the packaging detection circuit 530 detects that the packaging 502 is being opened and removed from the headset 504 and the switch is activated. The signal that is sent to the headset 504 may cause the headset 504 to play one or more pre-loaded audio messages such as a welcome message or greeting, and/or setup and configuration instructions. The signal may comprise, for example, an NFC signal.

In some embodiments of the disclosure, the headset 504 may be operable to detect when the packaging 502 is being opened and removed from the headset 504. In instances when the headset 504 detects that the packaging 502 is being opened and removed from the headset 504, the headset 504 may be operable to play one or more pre-loaded audio messages such as a welcome message or greeting, and/or setup and configuration instructions via the speakers 504*d*. The headset 504 may detect when the packaging 502 is being opened and removed from the headset 504 based on information that may be received from the integrated detection circuit 504*e*.

The speakers 504*d* may be substantially similar to the speakers 216*a* and 216*b*, for example, which are shown in and described with respect to FIGS. 2A, 2B and 2C. The speakers 504*d* may be operable to play pre-loaded audio messages such as a welcome message or greeting, and/or setup and configuration instructions.

The audio processor 504*a* may comprise suitable logic, circuitry, interfaces and/or code that may be operable to play pre-loaded audio messages such as a welcome message or greeting, and/or setup and configuration instructions. The audio processor 504*a* may be substantially similar to the audio processing circuit 230, for example, which is shown in and described with respect to FIG. 2C. The CPU 522 may be operable to configure the audio processor 504*a* to play one or more of the preloaded messages. As part of the interactive instructions that may be controlled by the CPU 522, the audio processor 504*a* may be operable to process one or more responses that may be received from the person setting up the headset 504. The responses that may be received from the person setting up the headset 504 may be captured by the microphone 504*f*. In this regard, the audio processor 504*a* may also be operable to process the one or more responses that may be received from a person setting up the headset via the microphone 504*f*. The CPU 522 may be operable to control playback of the predefined messages based on the processed one or more responses. The CPU 522 may be operable to select one or more settings that may be utilized to setup and configure one or more parameters and/or options for the headset 504. In addition to the welcome message or greeting, and/or setup and configuration instructions, the audio processor 504*a* may also be operable to play one or more unpacking instructions, maintenance or care instructions, and/or the customization instructions. The CPU 522 may also be operable to customize the headset 504 for the person setting up the headset 504 based on the results of the processing of the one or more responses by the audio processor 504*a* and the customization instructions.

The internal storage device 504*b* may comprise one or more suitable devices that may comprise suitable logic, circuitry, interfaces and/or code that may be operable to store audio information for a game and/or for the headset 504. The audio information may comprise preloaded messages comprising, for example, the welcome message or greeting, the unpacking instructions, the setup instructions, the configuration instructions, the maintenance or care instructions, and/or the customization instructions.

The internal storage device 504*b* may be substantially similar to the storage device 224, for example, which is shown in and described with respect to FIG. 2C. The audio information may be stored in, for example, the sounds database 504*c*.

The CPU 522 may comprise suitable logic, circuitry, interfaces and/or code that may be operable to execute instructions for controlling, managing and/or coordinating the overall operation of the headset 504. In this regard, the CPU 522 may be operable to control, manage and coordinate operation of the components in the headset 504, which comprises the audio processor 504*a*, the internal storage device 504*b*, and the sounds database 504*c*. The CPU 522 may also be operable to coordinate and manage operations between the headset 504, and the packaging detection circuit 530. The CPU 522 may be substantially similar to the CPU 222, for example, which is shown in and described with respect to, for example, FIG. 2C.

The CPU 522 may be operable to detect when the headset 504 is being removed from its packaging and in response, the CPU 522 may be operable to control operation of the audio processor 504*a* to play one or more pre-loaded messages such as a welcome message or greeting, and/or setup and configuration instructions. The CPU 522 may be operable to establish an interactive setup session with the person that is unpacking and setting up the headset 504. In this regard, the CPU 522 may configure the audio processor

504*a* to present various questions to the person setting up the headset 504. The person setting up the headset 504 may respond with corresponding responses, which may be captured by the microphone 504*f*. The captured responses may be processed by the audio processor 504*a*. Based on the results from the processing by the audio processor 504*a*, the CPU 522 may select various settings and configure one or more parameters and/or options for the headset 504 with the selected settings.

The CPU 522 may also be operable to guide the person that is removing the headset 504 from its packaging 502 through the steps that should be utilized for unpacking or removing the headset 504 from its packaging 502. In this regard, the audio processor 504*a* and the CPU 522 may be operable to generate instructions comprising a plurality of sequential steps, which may be played through the speakers 504*d*. The plurality of sequential steps may inform the person that is removing the headset 504 from the packaging 502 of the order in which the parts in the packaging 502 should be removed and what should be done with each part (e.g., with respect to assembly or set-up). The CPU 522, audio processor 504*a*, and/or the speakers 504*d* may be operable to provide instructions on what to do with each part as each part is being pulled out of the packaging 502. The CPU 522 may also play pre-loaded instructions that notify the person that is removing the headset 504 from the packaging 502 about what is the next part that is to be pulled out of the packaging 502. The sequence of the steps may be dependent on the responses that may be received from the person that is removing the headset 504 from its packaging. In this regard, each of the sequential steps may occur as a result of a response that is received from the person that is removing the headset 504 from its packaging 502.

The integrated detection circuit 504*e* may comprise suitable logic, circuitry, interfaces and/or code that is operable to detect when the packaging 502 is being opened and/or removed from the headset 504. For example, the integrated detection circuit 504*e* may comprise an NFC device, which is operable to detect when the packaging 502 is being opened and/or removed from the headset 504. In instances when the integrated detection circuit 504*e* detects that the packaging 502 is being opened and/or removed from the headset 504, the integrated detection circuit 504*e* may cause the NFC device to send a signal to the CPU 522. The CPU 522 may be operable to control the audio processor 504*a* to play one or more pre-loaded messages when the CPU 522 receives the signal from the integrated detection circuit 504*e*. In an exemplary embodiment of the invention, the integrated detection circuit 504*e* may comprise a metallic strip that forms a closed circuit when the packaging 502 is unopened. The metallic strip may extend around an area of the packaging 502 that is to be opened. When the packaging 502 is opened, the metallic strip is broken and this causes the circuit to be opened. The opening of the circuit may trigger, for example, the NFC device to send the signal to the headset 504.

The microphone 504*f* may comprise suitable logic, circuitry, interfaces and/or code that may be operable to capture responses that may be received from the person that is removing the headset 504 from the packaging 502. The responses captured by the microphone 504*f* may be communicated to the audio processor 504*a*.

In operation the CPU 522 may be operable to detect when the headset 504 is being removed from its packaging 502 and control operation of the audio processor 504*a* to play one or more pre-loaded audio message via the speakers 504*d*. Exemplary pre-loaded audio message may comprise the welcome message or greeting, the unpacking instructions, the setup instructions, the configuration instructions, the maintenance or care instructions, and/or the customization instructions. In accordance with an example embodiment of the disclosure, the pre-loaded messages may be utilized to provide an interactive audio dialog between the headset 504 and the person that is removing the headset 504 from its packaging 502. The CPU 522, the audio processor 504*a*, the speakers 504*d*, and the microphone 504*f* may be operable to generate the interactive audio dialog. Responses from the person setting up the headset 504 may be utilized by the audio processor 504*a* to customize setup of the headset 504 for one or more users.

For the interactive dialog, the CPU 522 may be operable to control the audio processor 504*a* to generate one or more audio prompts via the speakers 504*d*. In response to one or more audio prompts or instructions for the interactive audio dialog, the audio processor 504*a* may be operable to receive one or more corresponding audio responses from the person that may be removing the headset 504 from the packaging 502. The corresponding audio responses may be captured by the microphone 504*f* and processed by the audio processor 504*a*. The CPU 522 may be operable to select one or more settings for configuring the headset 504 based on results of the processing by the audio processor 504*a*. The CPU 522 may be operable to configure one or more parameters or options for the headset 504 utilizing the selected settings.

FIG. 5B is a diagram illustrating an exemplary electronic packaging for a headset, in accordance with various exemplary embodiments of the disclosure. Referring to FIG. 5B, there is shown an electronic packaging 550 comprising packaging 552, a headset 504, package detection circuit 554, a conductor 556, and NFC device 560. The packaging 552 comprises a flap 558.

The packaging 552 may be substantially similar to the packaging 502, for example, which is shown in and described with respect to FIG. 5A.

The headset 504 may be substantially similar to the electronic packaging 504, for example, which is shown in and described with respect to FIG. 5A.

The package detection circuit 554 may be substantially similar to the packaging detection circuit 530, for example, which is shown in and described with respect to FIG. 5A.

The conductor 556 may comprise a conductive strip that may be affixed to a first portion of the packaging 552 such as the side of the packaging 552 and to a second portion of the packaging such as the flap 558. As shown, the portions of the conductor 552 on the flap 558 are illustrated as 556*a*', 556*b*', and the portions of the conductor 552 on the side of the packaging 502 are illustrated as 556*a*, 556*b*. When the flap 558 is closed, the conductor is unbroken meaning the conductor portions 556*a* and 556*a*' are coupled together and the conductor portions 556*b* and 556*b*' are coupled together, thereby creating a closed circuit. The conductor 556 is coupled to the package detection circuit 554. When the flap 558 is opened, the conductor is broken meaning the conductor portions 556*a* and 556*a*' are decoupled and the conductor portions 556*b* and 556*b*' are decoupled, thereby creating an open circuit. In another implementation, a circuit may be broken while the flap 558 is closed and unbroken when the flap 558 is open. For example, a portion of the flap may sit between two portions of the circuit when it is closed and the two portions may make contact with each other upon the flap 558 being opened and no longer being between the two portions.

The NFC device 560 may comprise suitable logic, circuitry, interfaces and/or code that may be operable to receive a signal from the package detection circuit 554 when the conductor portions 556*b* and 556*b*' are decoupled. In response to receiving the signal from the package detection circuit 554, the NFC device 560 may communicate a message to the headset 504 to start playing a pre-loaded message or greeting.

In operation, when the person opening the packaging 552 moves the flap 558 from its closed position to the open position, the conductor portions 556*a* and 556*a*' are decoupled and the conductor portions 556*b* and 556*b*' are decoupled, thereby creating an open circuit. This decoupling of the conductor 556 may break a circuit and cause the package detection circuit 554 to send a signal to the NFC device 560. In response to receiving the signal, the NFC device 560 may be operable to communicate a message to the headset 504 to start playing a pre-loaded message or greeting. The radio 126 (FIG. 1A) in the headset 504 may be operable to receive the message from the NFC device 560.

In some embodiments of the disclosure, the decoupling of the conductor 556 may cause the package detection circuit 530 to start playing the pre-loaded message or greeting as illustrated in FIG. 5D.

FIG. 5C is a diagram illustrating an exemplary electronic packaging for a headset, in accordance with various exemplary embodiments of the disclosure. Referring to FIG. 5B, there is shown an electronic packaging 570 comprising packaging 552, a headset 504, package detection circuit 554, a switch 562, and NFC device 560. The packaging 552 comprises a flap 558.

The packaging 552 may be substantially similar to the packaging 502, for example, which is shown in and described with respect to FIG. 5A.

The headset 504 may be substantially similar to the electronic packaging 504, for example, which is shown in and described with respect to FIG. 5A.

The package detection circuit 554 may be substantially similar to the packaging detection circuit 530, for example, which is shown in and described with respect to FIG. 5A.

The switch 562 may comprise a first switch portion 562*a* that may be affixed to a first portion of the packaging 552 such as the side of the packaging 552 and a second switch portion 562*b* of the packaging 552 such as the flap 558. As shown, the portion of the switch 562 on the flap 558 is illustrated as 562*b* and the portion of the switch 562 on the side of the packaging 502 is illustrated as 562A. When the flap 558 is closed, the switch 562 is closed since the first switch portion 562*a* is in close proximity to the second switch portion 562*b*. When the flap 558 is opened, the switch 562 is opened since the first switch portion 562*a* is not in close proximity to the second switch portion 562*b*. The switch 560 may comprise, for example, a magnetic switch.

The NFC device 560 may comprise suitable logic, circuitry, interfaces and/or code that may be operable to receive a signal from the package detection circuit 554 when the switch 562 is opened. In response to receiving the signal from the package detection circuit 554, the NFC device 560 may communicate a message to the headset 504 to start playing a pre-loaded message or greeting.

In operation, when the person opening the packaging 552 moves the flap 558 from its closed position to the open position, the switch 562 is opened. The opening of the switch 562 may cause the package detection circuit 554 to send a signal to the NFC device 560. In response to receiving the signal, the NFC device 560 may communicate a message to the headset 504 to start playing a pre-loaded message or greeting, and/or instructions. The radio 126 (FIG. 1A) in the headset 504 may be operable to receive the message from the NFC device 560.

In some example embodiments of the disclosure, the decoupling of the switch 562 may cause the package detection circuit 530 to start playing the pre-loaded message or greeting as illustrated in FIG. 5D.

FIG. 5D is a block diagram of an exemplary package detection circuit, in accordance with various embodiments of the disclosure. Referring to FIG. 5D, there is shown a package detection circuit 580 comprising a battery 582, a piezo speaker 584, an audio player 586, a processing circuit 588, and memory 590. The package detection circuit 580 comprising the battery 582, the piezo speaker 584, the audio player 586, the processing circuit 588, and the memory 590 may be integrated as a single unit.

The battery 582 may be operable to power the components of the package detection circuit 580.

The piezo speaker 584 may be operable to play a pre-loaded audio message such as a welcome message or greeting and/or setup and configuration instructions.

The audio player 586 may be operable to play a pre-loaded audio message such as a welcome message or greeting, and/or setup and configuration instructions.

The processing circuit 588 may comprise suitable logic, circuitry, interfaces and/or code that may be operable to process signals that may be received from a conductor 556 (FIG. 5B) or switch 562 (FIG. 5C). The processing circuit 588 may be operable to control operation of the package detection circuit 580.

The memory 590 may comprise suitable logic, circuitry, interfaces and/or code that store pre-loaded audio messages and/or instructions such as a welcome message or greeting, and/or setup and configuration instructions.

In operation, the packaging detection circuit 580 may be operable to receive signal when the conductor 556 (FIG. 5B) or switch 562 (FIG. 5C) is activated. In response to receiving the signal, processing circuit 588 may trigger the audio player 586 to retrieve one or more pre-loaded audio messages from the memory 590. In this regard, the audio player 586 may play a welcome message or greeting, and/or setup and configuration instructions via the peizo speaker 584

In some embodiments of the disclosure, when the packaging detection circuit 530 receives the signal from the conductor 556 (FIG. 5B) or switch 562 (FIG. 5C), the processing circuit 588 may be operable to send a message to the headset 504. In this regard, the processing circuit 588 may be operable to activate the NFC device 560 (FIG. 5D) to send the message to the headset 504. The signal that is sent to the headset 504 may cause the headset 504 to play one or more pre-loaded audio messages such as a welcome message or greeting, and/or setup and configuration instructions via the speakers 216*a*, 216*b* (FIG. 2C).

Figure 6:
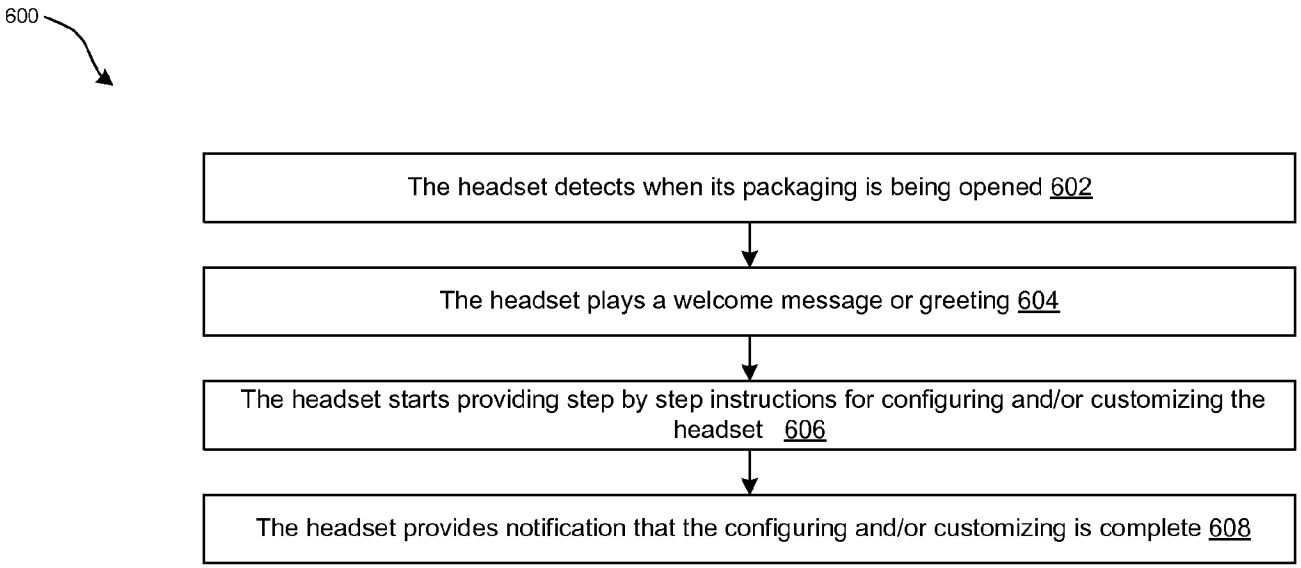
FIG. 6 is a flow diagram illustrating exemplary steps for electronic packaging for a headset, in accordance with various exemplary embodiments of the disclosure.

FIG. 6 is a flow diagram illustrating exemplary steps for electronic packaging for a headset, in accordance with various exemplary embodiments of the disclosure. Referring to FIG. 6, there is shown a flow chart 600 comprising a plurality of exemplary steps, namely, 602 through 608. In step 602, the headset 504 may be operable to detect when its packaging is being opened. In step 604, the headset 504 may be operable to play a welcome message or greeting. In step 606, the headset 504 may be operable to start providing step by step instructions for configuring and/or customizing the headset. In step 608, the headset 504 may be operable to provide notification that the configuring and/or customizing is complete.

Figure 7:
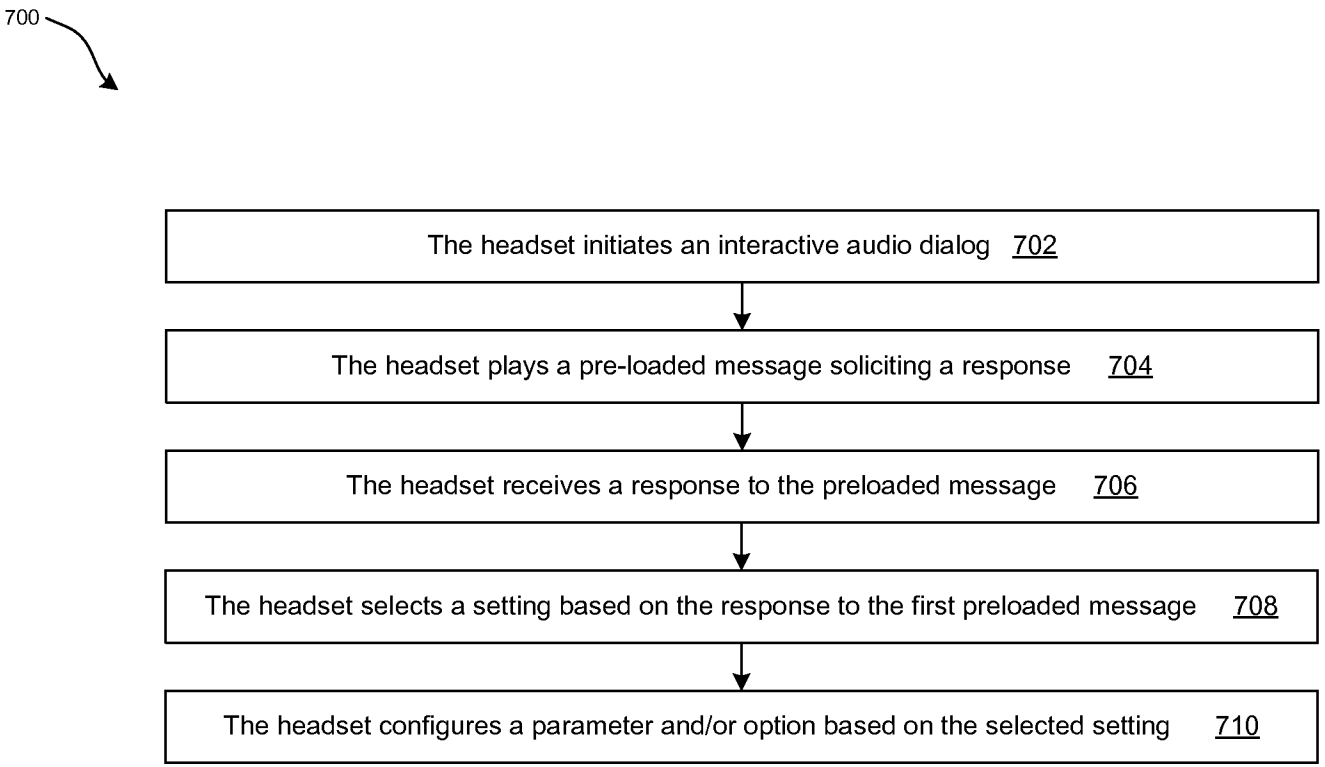
FIG. 7 is a flow diagram illustrating exemplary steps for electronic packaging functionality for a headset, in accordance with various exemplary embodiments of the disclosure.

FIG. 7 is a flow diagram illustrating exemplary steps for electronic packaging functionality for a headset, in accordance with various exemplary embodiments of the disclosure. Referring to FIG. 7, there is shown a flow chart 700 comprising a plurality of exemplary steps, namely, 702 through 710. In step 702, the headset 504 may be operable to initiate an interactive audio dialog. In step 704, the headset 504 may be operable to play a pre-loaded message soliciting a response. In step 706, the headset 504 may be operable to receive a response to the preloaded message. In step 708, the headset 504 may be operable to select a setting based on the response to the first preloaded message. In step 710, the headset 504 may be operable to configure a parameter and/or option based on the selected setting.

Figure 8:
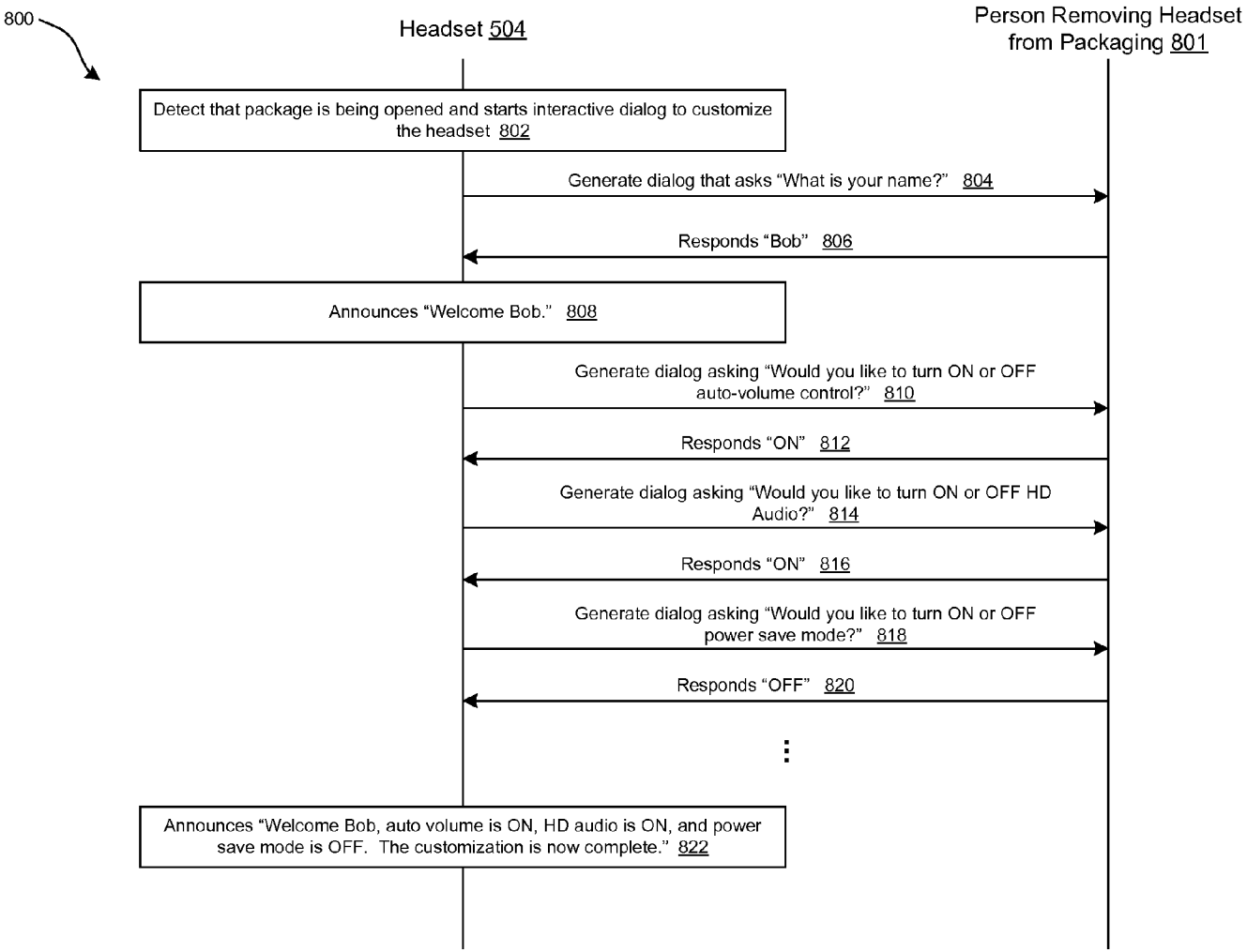
FIG. 8 is a flow diagram illustrating an exemplary interactive audio dialog, in accordance with various exemplary embodiments of the disclosure.

FIG. 8 is a flow diagram illustrating an exemplary interactive audio dialog, in accordance with various exemplary embodiments of the disclosure. Referring to FIG. 8, there is shown a flow diagram 800 comprising a headset 504, a person removing the headset from a packaging 801, and a plurality of steps 802 though 822.

In step 802, the headset 504 is operable to detect that the packaging is being opened and start an interactive dialog to customize the headset 504. In step 804, the headset 504 is operable to generate a dialog that asks "What is your name?". In step 806, the person removing the headset from a packaging 801 responds "Bob." In step 808, the headset 504 is operable to announce "Welcome Bob." In step 810, the headset 504 is operable to generate a dialog asking "Would you like to turn ON or OFF auto-volume control?". In step 812, the person removing the headset from a packaging 801 responds "ON." In step 814, the headset 504 is operable to generate dialog asking "Would you like to turn ON or OFF HD Audio?". In step 816, the person removing the headset from a packaging 801 responds "ON." In step 818, the headset is operable to generate dialog asking "Would you like to turn ON or OFF power save mode?". In step 820, the person removing the headset from a packaging 801 responds "OFF." In step 822, the headset 504 is operable to announce "Welcome Bob, auto volume is ON, HD audio is ON, and power save mode is OFF. The customization is now complete." The questions of FIG. 8 are merely examples only, and any series of questions is possible.

In accordance with an exemplary embodiment of the disclosure, a product packaging 502 comprises a speaker 504*d*, and circuitry such as a headset 504, a packaging detection circuit 530 and/or an integrated detection circuit 504*e*. The packaging detection circuit 530 and/or the integrated detection circuit 504*e* may be operable to detect when the product is removed from the packaging 502 and/or when the packaging 502 is opened. In response to detecting the removal and/or opening, the headset 504 may be operable to play one or more pre-loaded audio messages via the speaker 504*d*. The pre-loaded audio message may comprise a welcome message and/or setup instructions, which may be interactive. The headset 504 and/or the speaker 504*d* may be operable to generate an interactive audio dialog that is utilized to customize setup of the headset 504. The headset 504 may be operable to receive one or more corresponding audio responses from a user or person setting up the headset, in response to one or more audio prompts for the interactive audio dialog. The headset 504 may be operable to select one or more settings for the headset 504 based on the received one or more corresponding audio responses. The headset 504 may be operable to configure the headset 504 based on the selected one or more settings. The headset 504 may be operable to generate an audio summary of the selected one or more settings. The headset 504 may be operable to present an audio and/or visual notification when the configuring of the headset 504 is complete. As each part is pulled out of the packaging 502, the speaker 504*d* may be operable to play instructions on what to do with each part and (e.g., with respect to assembly or set-up) what is the next part that is to be pulled out of the packaging 502.

While the discussion herein regarding electronic packaging has focused primarily on headsets (e.g., gaming headsets), the present disclosure is not so limited. Accordingly, the described electronic packaging can be applied to virtually any product, electronic or otherwise.

As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Throughout this disclosure, the use of the terms dynamically and/or adaptively with respect to an operation means that, for example, parameters for, configurations for and/or execution of the operation may be configured or reconfigured during run-time (e.g., in, or near, real-time) based on newly received or updated information or data. For example, an operation within a transmitter and/or a receiver may be configured or reconfigured based on, for example, current, recently received and/or updated signals, information and/or data.

The present method and/or system may be realized in hardware, software, or a combination of hardware and software. The present methods and/or systems may be realized in a centralized fashion in at least one computing system, or in a distributed fashion where different elements are spread across several interconnected computing systems. Any kind of computing system or other apparatus adapted for carrying out the methods described herein is suited. A typical combination of hardware and software may be a general-purpose computing system with a program or other code that, when being loaded and executed, controls the computing system such that it carries out the methods described herein. Another typical implementation may comprise an application specific integrated circuit or chip. Some implementations may comprise a non-transitory machine-readable (e.g., computer readable) medium (e.g., FLASH drive, optical disk, magnetic storage disk, or the like) having stored thereon one or more lines of code executable by a machine, thereby causing the machine to perform processes as described herein.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

What is claimed is:

1. A method comprising:

detecting, by a magnetic switch of a packaging of a gaming headset, removal of said gaming headset from said packaging;

transmitting, by circuitry of said packaging, a signal to said gaming headset in response to said detecting said removal of said gaming headset;

receiving, by circuitry of said gaming headset, said signal transmitted by said circuitry of said packaging, and in response to receipt of said signal, playing, by said circuitry of said gaming headset, one or more pre-loaded audio messages via a speaker of said gaming headset, wherein:

said one or more pre-loaded audio messages are part of an interactive audio dialog that is utilized to customize setup of a gaming headset; and said one or more pre-loaded audio messages comprise one or more audio prompts for said interactive audio dialog, and the method comprises receiving one or more corresponding audio responses from a user of said gaming headset.

2. The method according to claim 1, wherein said one or more pre-loaded audio message comprises a welcome message.

3. The method according to claim 1, wherein said one or more pre-loaded audio message comprises setup instructions.

4. The method according to claim 1, wherein said one or more pre-loaded audio message comprises interactive setup instructions.

5. The method according to claim 1, comprising selecting, by said circuitry of said gaming headset, one or more settings for said gaming headset based on said received one or more corresponding audio responses.

6. The method according to claim 5, comprising configuring, by said circuitry of said gaming headset, said gaming headset based on said selected one or more settings.

7. The method according to claim 6, comprising presenting, by said circuitry of said gaming headset, an audio and/or visual notification when said configuring of said gaming headset is complete.

8. The method according to claim 5, comprising generating, by said circuitry of said gaming headset, an audio summary of said selected one or more settings.

9. A system comprising:

product packaging comprising a magnetic switch and transmit circuitry; and a gaming headset comprising receive circuitry, audio processing circuitry, and a speaker, wherein:

said magnetic switch is operable to detect removal of a gaming headset from said packaging, from said packaging;

said transmit circuitry is operable to transmit a signal to said gaming headset in response to said detection of said removal of said gaming headset;

said receive circuitry is operable to receive said signal transmitted by said transmit circuitry;

said audio processing circuitry is operable to, in response to receipt of said signal, play one or more pre-loaded audio messages via said speaker of said gaming headset;

said one or more pre-loaded audio messages are part of an interactive audio dialog that is utilized to customize setup of a gaming headset;

said one or more pre-loaded audio messages comprise one or more audio prompts for said interactive audio dialog; and said audio processing circuitry is operable to receive one or more corresponding audio responses from a user of said gaming headset.

10. The system according to claim 9, wherein said one or more pre-loaded audio message comprises a welcome message.

11. The system according to claim 9, wherein said one or more pre-loaded audio message comprises setup instructions.

12. The system according to claim 9, wherein said one or more pre-loaded audio message comprises interactive setup instructions.

13. The system according to claim 9, wherein said headset comprises circuitry operable to select one or more settings for said gaming headset based on said received one or more corresponding audio responses.

14. The system according to claim 13, wherein said headset comprises circuitry operable to:

configure said gaming headset based on said selected one or more settings; and generate an audio summary of said selected one or more settings.

15. The system according to claim 14, wherein said headset comprises circuitry operable to present an audio and/or visual notification when said configuring of said gaming headset is complete.

16. A non-transitory computer readable medium having stored thereon, a computer program having at least one code section that is executable by a machine for causing the machine to perform steps comprising:

detecting, by a magnetic switch of packaging of a gaming headset, removal of said gaming headset from said packaging;

transmitting, by circuitry of said packaging, a signal to said gaming headset in response to said detecting said removal of said gaming headset;

receiving, by circuitry of said gaming headset, said signal transmitted by said circuitry of said packaging, and in response to receipt of said signal, playing, by said circuitry of said gaming headset, one or more pre-loaded audio messages via a speaker of said gaming headset wherein said one or more pre-loaded audio messages are part of an interactive audio dialog that is utilized to customize setup of a gaming headset; and said one or more pre-loaded audio messages comprise one or more audio prompts for said interactive audio dialog, and the method comprises receiving one or more corresponding audio responses from a user of said gaming headset.

* * * * *